US007088929B2

(12) United States Patent
Ahn

(10) Patent No.: US 7,088,929 B2
(45) Date of Patent: Aug. 8, 2006

(54) APPARATUS TO MEASURE AN AMOUNT OF TONER CONSUMED AND METHOD THEREOF

(75) Inventor: Dong-cheol Ahn, Suwon-si (KR)

(73) Assignee: Samsung Electronics, Co., Ltd., Suwon-si (KR)

( * ) Notice: Subject to any disclaimer, the term of this patent is extended or adjusted under 35 U.S.C. 154(b) by 29 days.

(21) Appl. No.: 10/940,814

(22) Filed: Sep. 15, 2004

(65) Prior Publication Data

US 2005/0135819 A1 Jun. 23, 2005

(30) Foreign Application Priority Data

Dec. 22, 2003 (KR) ..... 10-2003-0094443

(51) Int. Cl.
*G03G 15/08* (2006.01)

(52) U.S. Cl. ..... 399/27

(58) Field of Classification Search ..... 399/27, 399/28

See application file for complete search history.

(56) References Cited

U.S. PATENT DOCUMENTS 5,349,377 A * 9/1994 Gilliland et al.
5,459,556 A 10/1995 Acquaviva et al.
5,655,174 A * 8/1997 Hirst ..... 399/27
5,787,320 A * 7/1998 Eun et al. ..... 399/27
5,802,420 A 9/1998 Garr et al.

FOREIGN PATENT DOCUMENTS

| | | |
|---|---|---|
| JP | 02-272471 | 7/1990 |
| JP | 11-005300 | 1/1999 |
| JP | 11-227173 | 8/1999 |
| JP | 2002-328568 | 11/2002 |

* cited by examiner

*Primary Examiner*—Arthur T. Grimley
*Assistant Examiner*—Laura K. Roth
(74) *Attorney, Agent, or Firm*—Stanzione & Kim, LLP

(57) ABSTRACT

A toner consumption measuring apparatus having an effective signal generating unit to receive inputs of printing data and a video clock signal to synchronize the printing data and to generate a count effective signal, a counting unit to count the generated count effective signal and to calculate a number of pixels of the printing data, a coefficient memory to store at least a toner consumption coefficient of a unit of pixel 'K' which is set in advance, and a printer control unit to determine an image pattern compensation coefficient by using the differences of numbers of the pixels of adjacent lines of a page in printing of every page, and calculating a toner consumption with applying a proper weight in accordance with the determined image pattern compensation coefficient.

33 Claims, 19 Drawing Sheets

APPARATUS TO MEASURE AN AMOUNT OF TONER CONSUMED AND METHOD THEREOF

CROSS-REFERENCE TO RELATED APPLICATIONS

This application claims the benefit of Korean Patent Application No. 2003-94443 filed Dec. 22, 2003, in the Korean Intellectual Property Office, the disclosure of which is incorporated herein by reference.

BACKGROUND OF THE INVENTION

1. Field of the Invention

The present general inventive concept relates to an apparatus and a method thereof to measure an amount of toner consumed in a printing system which includes an image forming apparatus, and more particularly, to an apparatus and a method thereof to measure toner consumption in a printing system, which is capable of measuring the toner consumption by applying different weights in accordance with the varying operation mode and image pattern of the printing system.

2. Description of the Related Art

FIG. 1 shows a general structure of a conventional printing system 1. As shown, the conventional printing system 1 mainly comprises a laser beam printer 10 and a computer 12.

The laser beam printer 10 is used in connection with the computer 12 via a communication interface 70.

The computer 12 transmits data to the laser beam printer 10 via the communication interface 70, and the printer 10 processes the received data for corresponding printing operations.

The printer 10 usually comprises the communication interface 70 constituting a connection between the computer 12 and the printer 10 for data transmission and reception, a program memory 20 storing therein a variety of control programs for the execution of the printer functions, a data memory 30 for storing a variety of data as they are generated in accordance with the execution of the control programs, a controller 13 for controlling respective parts of the printer 10 by executing the control programs, a printer engine 60 for driving printer mechanism under control of the controller 13, an operation panel 40 for the input of user command or selection, and a display 14 for displaying status of the printer.

In the printing system 1 as described above, toner consumption can be measured by installing a toner sensor (not shown) having light emitting and receiving elements in a toner cartridge (not shown), and notifying to the user of a sensed toner consumption as necessary. However, this approach requires a toner sensor and detection circuit, which subsequently increases a manufacturing cost of the printer.

Another way of measuring toner consumption is by counting the pages of printed paper since the mounting of a new toner cartridge. It is determined that the toner is exhausted when the counted number of printed pages exceeds a certain predetermined limit, and the user is notified of the same. For example, if a toner supplier guarantees 5000 pages of printing on the A4 sheets with a single toner cartridge, it can be presumed that the toner would be used up when the printed pages exceed 5000 pages.

However, the second approach has a shortcoming of inaccurate reference for determining toner exhaustion. That is, the toner suppliers estimate the printable pages with one toner cartridge generally based on the assumption that approximately 4% to 5% of the paper area requires the toner attachment. However, when considering the fact that the printing images usually vary among solid patterns such as black dots, character patterns such as lines and text, or halftone patterns such as graphs and drawings, the toner may be used up well before the printed pages reach the estimated printable pages, or a sufficient amount of toner may still be left even after the pages exceed the estimation.

Because it cannot be confirmed for sure that every page of the printing requires toner fixation for 4% to 5% of its area, accurate measurement of toner consumption cannot be guaranteed.

In order to resolve the problems mentioned above, another approach suggests to count the number of pixels of printing data synchronized to the video clock, and multiply the coefficients of toner consumption per pixel unit according to the counted pixels.

However, because this approach calculates toner consumption only based on the number of pixels of the counted printing data, by the Fringe effect, it cannot reflect the variations in toner consumption mainly according to varying modes of the operation such as print mode and a copy mode, and image patterns such as a solid pattern, a character pattern and a halftone pattern. Therefore, accurate toner consumption measurement cannot be guaranteed.

For example, according to the experiment conducted by the present applicant, toner consumption per pixel varies, depending on the operation mode and image pattern in use. The results of the experiment are listed in the table 1 below. As shown, toner consumption is the largest in the halftone pattern in the print mode, while the largest amount of toner is consumed in the solid pattern in the photo mode which is the sub operation mode of the copy mode.

TABLE 1

| | 5% solid pattern | 5% character pattern | 5% halftone pattern |
|---|---|---|---|
| Print mode | $1.37 \times 10^{-08}$ g | $1.34 \times 10^{-08}$ g | $1.43 \times 10^{-08}$ g |
| Photo copy mode | $2.34 \times 10^{-08}$ g | $1.92 \times 10^{-08}$ g | $1.44 \times 10^{-08}$ g |

In order to overcome the shortcomings of the third approach, a suggestion has been made to calculate a laser diode turn-on ratio by counting the frequency of a laser beam emitted from a laser diode per a certain unit of pixel during the multiplication of the number of pixels of the counted printing data by the consumption coefficient, and use the calculated laser diode turn-on ratio as a compensate coefficient.

However, this fourth suggestion requires software programs for the data processing in frequency reading, which subsequently increases the program loads. Also, it has the possibility of errors in the software.

Furthermore, in the photo mode, which is the sub operation mode of the copy mode, the laser diode turn-on ratio is usually perceived to be similar between the solid pattern and the halftone pattern when the document is processed into data, and therefore, toner consumption can be measured to be similar. Therefore, the fourth approach also has a limit in accurately reflecting the difference of actual toner consumption between the solid pattern and the halftone pattern as indicated in the table 1.

SUMMARY OF THE INVENTION

The present general inventive concept has been developed in order to solve the above drawbacks and other problems associated with the conventional arrangement. An aspect of the present invention is to provide an apparatus and a method thereof to measure toner consumption, which is capable of increasing accuracy of toner consumption measurement according to varying image patterns and preventing errors in toner consumption measurements, by measuring the toner consumption by use of appropriate weights according to the image pattern, with the image pattern being determined using a difference of numbers of pixels of adjacent lines of each page.

It is another aspect of the present general inventive concept to provide a toner consumption measuring apparatus and a method thereof, which is capable of preventing errors in toner consumption measurements due to varying image patterns and modes of operation, and also providing accurate toner consumption measurement, by measuring the toner consumption with applying different weights in accordance with image patterns which are determined by using operation modes and the differences of numbers of pixels of adjacent lines of a printing page.

It is yet another aspect of the present general inventive concept to provide a toner consumption measuring apparatus and a method thereof, which is capable of preventing errors in toner consumption measurements due to varying environment conditions and also providing accurate toner consumption measurements, by measuring toner consumption with applying different weights in accordance with the environment factors such as temperature and humidity.

It is yet another aspect of the present general inventive concept to provide a toner consumption measuring apparatus and a method thereof, which is capable of preventing errors in toner consumption measurements due to varying printing density and also providing accurate toner consumption measurement, by measuring the toner consumption with applying different weights in accordance with the printing density of the printing data.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a toner consumption measuring apparatus of a printing system having an image forming apparatus therein, the toner consumption measuring apparatus including an effective signal generating unit to receive inputs of printing data and a video clock signal 'VCLK' to synchronize the printing data, and to generate a count effective signal; a counting unit to count the generated count effective signal and to calculate a number of pixels of the printing data; a coefficient memory to store at least a toner consumption coefficient of a unit of pixel 'K' which is set in advance; and a printer control unit to determine an image pattern compensation coefficient by using the differences of numbers of the pixels of adjacent lines of a page in printing of every page, and calculating a toner consumption with applying a proper weight in accordance with the determined image pattern compensation coefficient.

The image pattern compensation coefficient is determined based on an average 'A', which is obtained by averaging the differences of numbers of pixels of adjacent lines in accordance with the number of pixels of a page 'Npixel', and based on the following equation:

$$A = \frac{1}{M}\sum\frac{(NLpixel - N1Lpixel)}{Npixel}$$

where, 'NLpixel' is a number of pixels of an Nth line of a page,

'N1Lpixel' is a number of pixels of an (N+1)th line of a page,

'Npixel' is a number of pixels of a page, and

'M' is a number of adjacent lines of a page (that is, total lines of a page—1).

The printer control unit uses the average 'A' as a compensation coefficient to compensate for the toner consumption which is calculated by using the number of pixels of a page 'Npixel' and the toner consumption coefficient of a unit of pixel 'K', to calculate a first toner consumption of a page 'PTM1', and accumulate the first toner consumption of a page 'PTM1' to calculate a first toner consumption 'TM1'.

The image pattern compensation coefficient may be determined as a plurality of image pattern compensation coefficients 'Kf' predetermined in accordance with an image pattern of the printing data and stored in the coefficient memory, the image pattern of the printing data being determined based on an average 'A', which is obtained by averaging the differences of numbers of pixels of adjacent lines in accordance with the number of pixels of a page 'Npixel', and based on the above equation.

The printer control unit selects one among the plurality of image pattern compensation coefficients 'Kf' based on the image pattern which is determined based on the operation mode and the average 'A', calculates a second toner consumption of a page 'PTM2' by using the selected image pattern compensation coefficient 'Kf' as a compensation coefficient to compensate for a toner consumption which is calculated by using the number of pixels of a page 'Npixel' and the toner consumption coefficient of a unit of pixel 'K', and then calculates a second toner consumption 'TM2' by accumulating the second toner consumption of a page 'PTM2'.

The toner consumption measuring apparatus may further include an operation mode input unit located in at least one of a printer driving program of an external computer and the operation panel of the image forming apparatus, so that information can be inputted for the printer control unit's selection of one image pattern compensation coefficient 'Kf'.

The operation mode input unit may include a print mode button to select a print mode, and a copy mode button to select a copy mode. The copy mode button may further include sub-taps such as text tap, text-photo tap, and photo tap.

The image pattern, which is determined in accordance with the operation mode and the average 'A', may include a solid pattern, a character pattern and a halftone pattern.

Alternatively, the coefficient memory may further store therein a plurality of environment compensation coefficients 'E' which are predetermined in accordance with the environment conditions, which are in turn predetermined in accordance with at least one among temperature and humidity. The printer control unit selects one among the plurality of stored environment compensation coefficients 'E' of the coefficient memory in accordance with the temperature, or humidity-based environment conditions, calculates a third toner consumption of a page 'PTM3' or a similar third toner consumption of a page 'PTM3'' by using the selected environment compensation coefficient 'E' as a compensation coefficient to compensate for the second toner consumption of a page 'PTM2' or the first toner consumption of a page 'PTM1', and calculates a third toner consumption 'TM3' or a similar third toner consumption 'TM3'' by accumulating the third toner consumption of a page 'PTM3' or the similar third toner consumption of a page 'PTM3''. Alternatively, the printer control unit may calculate a third toner consumption 'TM3' or a similar third toner consumption 'TM3'' by using the selected environment compensation coefficient 'E' as a compensation coefficient to compensate for the second toner consumption 'TM2' or the first toner consumption 'TM1'. The environment conditions may include a 'low-temperature/low-humidity state', a 'normal-temperature/normal-humidity state' and a 'high-temperature/high-humidity state.

Information is inputted for the printer control unit to select one among the plurality of stored environment compensation coefficients 'E' of the coefficient memory, and therefore, the toner consumption measuring apparatus may further include an environment condition detecting unit to detect the temperature inside the image forming apparatus and output the result to the printer control unit.

The environment condition detecting unit may include a temperature sensor which is located at a proper place inside the image forming apparatus, prevented from the influence of temperature, to determine whether the current atmospheric temperature is for normal operation of the image forming apparatus. Or, the environment condition detecting unit may include a transfer roller resistance detecting unit, which is arranged relative to the transfer roller to determine whether the current atmospheric temperature is for normal operation of the transfer roller.

Alternatively, the coefficient memory may further store a plurality of density compensation coefficients 'D' which are predetermined in accordance with the printing density of the printing data. In this case, the printer control unit selects one among the plurality of stored density compensation coefficients 'D' of the coefficient memory according to the printing density of the printing data, calculates a fourth toner consumption of a page 'PTM4' or a similar fourth toner consumption of a page 'PTM4'' by using the selected density compensation coefficient 'D' as a compensation coefficient to compensate for the second toner consumption of a page 'PTM2' or the first toner consumption of a page 'PTM1', and calculates a fourth toner consumption 'TM4' or a similar fourth toner consumption 'TM4'' by accumulating the fourth toner consumption of a page 'PTM4' or the similar fourth toner consumption of a page 'PTM4''. Alternatively, the printer control unit may calculate a fourth toner consumption 'TM4' or a similar fourth toner consumption 'TM4'' by using the selected density compensation coefficient 'D' as a compensation coefficient to compensate for the second toner consumption 'TM2' or the first toner consumption 'TM1'.

Information is inputted for the printer control unit to select one among the plurality of stored density compensation coefficients 'D' of the coefficient memory, and therefore, the toner consumption measuring apparatus may further include a density input unit in at least one among the printer driving program of the external computer and the operation panel of the image forming apparatus.

The density input unit may include a light-printing button, a normal-printing button, and a dark-printing button.

Alternatively, the coefficient memory may altogether store therein a plurality of environment compensation coefficients 'E' and a plurality of density compensation coefficients 'D'. In this case, the printer control unit selects one among the plurality of environment compensation coefficients 'E', which are stored in the coefficient memory in accordance with at least one among the temperature and the humidity, and selects one among the plurality of density compensation coefficients 'D', which are stored in the coefficient memory in accordance with the printing density, and uses the selected environment compensation coefficient 'E' and the density compensation coefficient 'D' as a compensation coefficient to compensate for the second toner consumption of a page 'PTM2' or the first toner consumption of a page 'PTM1' to calculate a fifth toner consumption of a page 'PTM5' or a similar fifth toner consumption of a page 'PTM5'', and calculates a fifth toner consumption 'TM5' or a similar fifth toner consumption 'TM5'' by accumulating the fifth toner consumption of a page 'PTM5' or the similar fifth toner consumption of a page 'PTM5''. Alternatively, the printer control unit may calculate a fifth toner consumption 'TM5' or a similar fifth toner consumption 'TM5'' by using the selected environment compensation coefficient 'E' and the density compensation coefficient 'D' as a compensation coefficient to compensate for the second toner consumption 'TM2' or the first toner consumption 'TM1'.

The toner consumption measuring apparatus may further include a display unit to display the first, second, third, fourth, or fifth toner consumption 'TM1', 'TM2', 'TM3', 'TM4', 'TM5', or the similar third, fourth, or fifth toner consumptions 'TM3'', 'TM4'', 'TM5''. The display unit may include a monitor of an external computer, or a liquid crystal display (LCD) arranged in near to the operation panel of the image forming apparatus.

The foregoing and/or other aspects and advantages of the present general inventive concept may also be achieved by providing a toner consumption measuring apparatus of a printing system having an image forming apparatus therein, the apparatus including: an effective signal generating unit to receive inputs of printing data and a video clock signal 'VCLK' to synchronize the printing data, and to generate a count effective signal; a counting unit to count the generated count effective signal and to calculate a number of pixels of the printing data; a coefficient memory to store therein a toner consumption coefficient of a unit of pixel 'K' which is set in advance, and a plurality of environment compensation coefficients 'E' which are predetermined in accordance with the predetermined environment conditions based on at least one among a temperature and humidity; and a printer control unit to calculate a sixth toner consumption 'TM6' by selecting one among the plurality of environment compensation coefficients 'E' in accordance with at least one among the temperature and the humidity, and using the selected environment compensation coefficient 'E' as a compensation coefficient to compensate for a toner consumption, which is calculated by using the toner consumption coefficient of a unit of pixel 'K' stored in the coefficient memory and the counted number of pixels of the printing data.

Information is inputted for the printer control unit to select one among the plurality of stored environment compensation coefficients 'E' of the coefficient memory, and therefore, the toner consumption measuring apparatus may further include an environment condition detecting unit to detect at least one of the temperature and the humidity of the image forming apparatus and output the result to the printer control unit.

The environment condition detecting unit may include a temperature sensor which is located at a proper place inside the image forming apparatus, prevented from the influence of temperature, to determine whether the current atmospheric temperature is for normal operation of the image forming apparatus. Alternatively, the environment condition detecting unit may include a transfer roller resistance detecting unit, which is arranged relative to the transfer roller to determine whether the current atmospheric temperature is for normal operation of the transfer roller.

The foregoing and/or other aspects and advantages of the present general inventive concept may also be achieved by providing a toner consumption measuring apparatus of a printing system having an image forming apparatus therein, the apparatus including an effective signal generating unit to receive inputs of printing data and a video clock signal 'VCLK' to synchronize the printing data, and to generate a count effective signal; a counting unit to count the generated count effective signal and calculate a number of pixels of the printing data; a coefficient memory to store therein a toner consumption coefficient of a unit of pixel 'K' which is set in advance, and a plurality of density compensation coefficients 'D' which are predetermined in accordance with a printing density of the printing data; and a printer control unit to calculate a seventh toner consumption 'TM7' by selecting one among the plurality of density compensation coefficients 'D' in accordance with the printing density of the printing data, and using the selected density compensation coefficient 'D' as a compensation coefficient to compensate for a toner consumption, which is calculated by using the toner consumption coefficient of a unit of pixel 'K' stored in the coefficient memory and the counted number of pixels of the printing data.

Information is inputted for the printer control unit to select one among the plurality of stored density compensation coefficients 'D' of the coefficient memory, and therefore, the toner consumption measuring apparatus may further include a density input unit in at least one among a printer driving program of an external computer and an operation panel of the image forming apparatus.

The density input unit may include a light-printing button, a normal-printing button, and a dark-printing button.

The foregoing and/or other aspects and advantages of the present general inventive concept may also be achieved by providing a toner consumption measuring method of an image forming apparatus, the method including: counting the number of pixels of printing data; determining an image pattern compensation coefficient by using the differences of numbers of pixels of adjacent lines of a page in the printing of every page; and calculating a toner consumption with applying a proper weight in accordance with the determined image pattern compensation coefficient.

According to an aspect of the present general inventive concept, the operation of calculating the number of pixels of the printing data includes: converting the printing data, which are synchronized to the video clock 'VCLK' and inputted into binary image data; and counting from the converted binary image data the number of pixels of the printing data which maintains a '0' or '1' value in a single video clock.

The operation of determining the image pattern compensation coefficient may include: calculating an average 'A', by averaging the differences of numbers of pixels of adjacent lines of a page in accordance with the above equation in the printing of every page. The operation of calculating the toner consumption may include: calculating the first toner consumption of a page 'PTM1' by using the average 'A' as a compensation coefficient to compensate for the toner consumption, which is calculated by using the toner consumption coefficient of a unit of a pixel 'K' and the counted number of pixels of a page 'Npixel'; and calculating the first toner consumption 'TM1' by accumulating the first toner consumption of a page 'PTM1' of respective pages.

Alternatively, the operation of determining the image pattern compensation coefficient may include selecting one among the plurality of image pattern compensation coefficients 'Kf' which are predetermined in accordance with the image pattern based on the mode of operation and the average 'A' calculated by the above equation. The operation of calculating toner consumption may include: calculating a second toner consumption of a page 'PTM2' by using the selected image pattern compensation coefficient 'Kf' as a compensation coefficient to compensate for the toner consumption, which is calculated by using the number of pixels of a unit of pixel 'K' and the number of pixels of a page 'Npixel'; and calculating a second toner consumption 'TM2' by accumulating the second toner consumption of each page 'PTM2'.

The operation of selecting one among the plurality of image pattern compensation coefficients 'Kf' may include: determining a mode of operation based on the information inputted through either the printer driving program of the external computer or the operation panel of the image forming apparatus; determining an image pattern based on the determined image operation mode and the calculated average 'A'; and selecting an image pattern compensation coefficient 'Kf' corresponding to the determined image pattern. The modes of operation may include a printing mode and a copy mode, and the image pattern may include a solid pattern, a character pattern, and a halftone pattern. The copy mode may include submodes such as a text mode, a text-photo mode and a photo mode.

The toner consumption measuring method may further include: selecting one among a plurality of environment compensation coefficients 'E' which are predetermined in accordance with at least one temperature, or humidity-based environment condition; and calculating a third toner consumption of a page 'PTM3' or a similar third toner consumption of a page 'PTM3'' by using the selected environment compensation coefficient 'E' as a compensation coefficient to compensate for the second toner consumption of a page 'PTM2' or the first toner consumption of a page 'PTM1', and then calculating a third toner consumption 'TM3' or a similar third toner consumption 'TM3'' by accumulating the calculated third toner consumption of a page 'PTM3' or the similar third toner consumption of a page 'PTM3'.

The operation of selecting one among the plurality of environment compensation coefficients 'E' may include: determining at least one among a temperature and humidity through one among a temperature sensor installed inside the image forming apparatus and a transfer roller resistance detecting unit installed relative to the transfer roller; determining environment conditions according to at least one of the determined temperature and humidity; and selecting an environment compensation coefficient 'E' corresponding to the determined environment condition. The environment condition may include a low-temperature/low-humidity state, a normal-temperature/normal-humidity state, and a high-temperature/high-humidity state.

Alternatively, the operation of calculating the third toner consumption 'TM3' or the similar third toner consumption 'TM3'' may include: using the environment compensation coefficient 'E' which is selected among the plurality of environment compensation coefficients 'E' as a compensation coefficient to compensate for the second toner consumption 'TM2' or the first toner consumption 'TM1'.

Additionally, the toner consumption measuring method may further include: selecting one among the plurality of density compensation coefficients 'D' which are predetermined in accordance with the printing density of the printing data; calculating a fourth toner consumption of a page 'PTM4' or a similar fourth toner consumption of a page 'PTM4'' by using the selected density compensation coefficient 'D' as a compensation coefficient to compensate for the second toner consumption of a page 'PTM2' or the first toner consumption of a page 'TM1', and calculating a fourth toner consumption 'TM4' or a similar fourth toner consumption 'TM4'' by accumulating the calculated fourth toner consumption of a page 'PTM4' or the similar fourth toner consumption of a page 'PTM4''.

The operation of selecting one density compensation coefficient 'D' may include: determining the printing density of the printing data based on the information inputted through at least one among the first density input unit of the printer driving program of the external computer and a second density input unit of the operation panel of the image forming apparatus; and selecting a density compensation coefficient 'D' which corresponds to the determined printing density. The printing density may include light printing, normal printing and dark printing.

Alternatively, the operation of calculating the fourth toner consumption 'TM4' or the similar fourth toner consumption 'TM4'' may include: using the density compensation coefficient 'D', which is selected in the density compensation coefficient selecting operation, as a compensation coefficient to compensate for the second toner consumption 'TM2' or the first toner consumption 'TM1'.

The toner consumption measuring method may further include: selecting one among the plurality of environment compensation coefficients 'E' and one among the plurality of density compensation coefficients 'D'; and calculating a fifth toner consumption of a page 'PTM5' or a similar fifth toner consumption of a page 'PTM5'' by using the selected environment compensation coefficient 'E' and the selected density compensation coefficient 'D' as a compensation coefficient to compensate for the second toner consumption of a page 'PTM2' or the first toner consumption of a page 'PTM1', and calculating a fifth toner consumption 'TM5' or a similar fifth toner consumption 'TM5'' by accumulating the calculated fifth toner consumption of a page 'PTM5' or the similar fifth toner consumption of a page 'PTM5''.

Alternatively, the operation of calculating the fifth toner consumption 'TM5' or the similar fifth toner consumption 'TM5' may include: using the selected environment compensation coefficient 'E' and the selected density compensation coefficient 'D' as a compensation coefficient to compensate for the second toner consumption 'TM2' or the first toner consumption 'TM1'.

The toner consumption measuring method may further include: displaying the first, second, third, fourth, or fifth toner consumption, or the similar third, similar fourth or similar fifth toner consumption. The toner consumption is displayed through a display unit which is positioned in at least one among the external computer and the image forming apparatus.

According to another aspect of the present general inventive concept, the toner consumption measuring method of an image forming apparatus includes: counting the number of pixels of printing data; determining an environment compensation coefficient 'E' in accordance with information including at least temperature and humidity; and calculating a sixth toner consumption 'TM6' by using the determined environment compensation coefficient 'E' as a compensation coefficient to compensate for the toner consumption, which is calculated by using a toner consumption coefficient of a unit of pixel 'K' and the number of pixels of the printing data.

The foregoing and/or other aspects and advantages of the present general inventive concept may also be achieved by providing a toner consumption measuring method of an image forming apparatus including: counting the number of pixels of printing data; determining a density compensation coefficient 'D' in accordance with a printing density of the printing data; and calculating a seventh toner consumption 'TM7' by using the determined density compensation coefficient 'D' as a compensation coefficient to compensate for the toner consumption, which is calculated by using a toner consumption coefficient of a unit of pixel 'K' and the number of pixels of the printing data.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
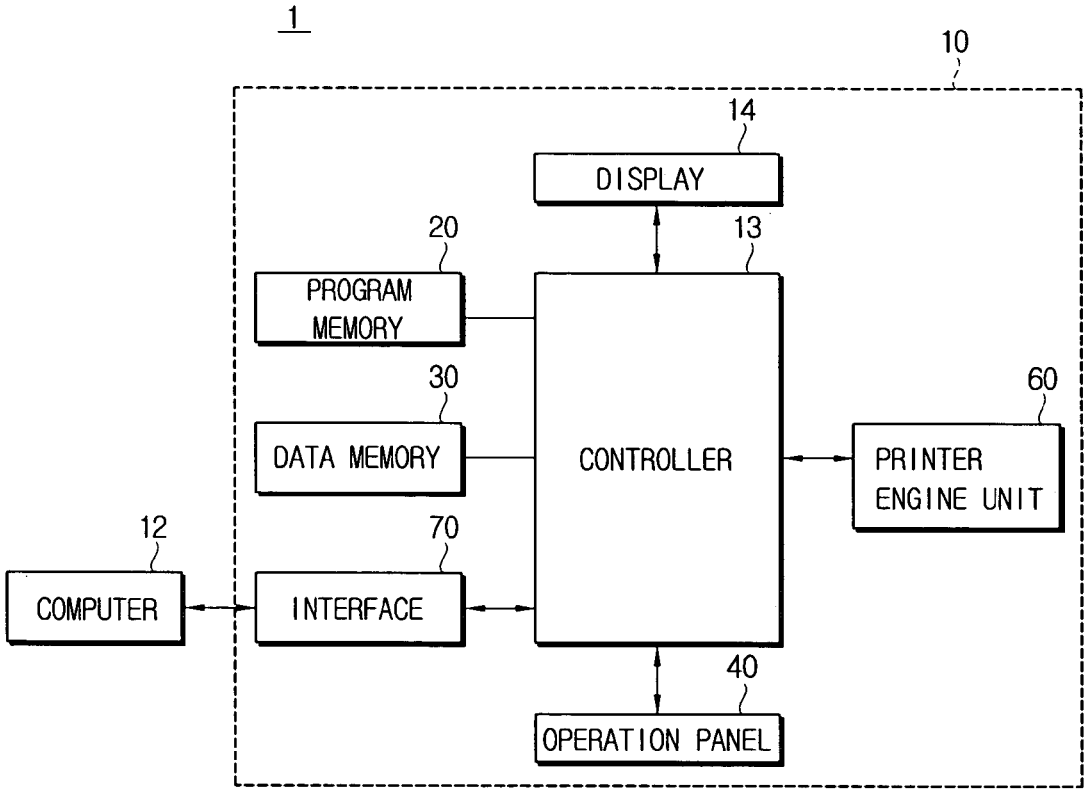
FIG. 1 (PRIOR ART)
FIG. 1 is a block diagram of a general printing system.

In the following description, same drawing reference numerals are used for the same elements even in different drawings. The matters defined in the description such as a detailed construction and elements are nothing but the ones provided to assist in a comprehensive understanding of the invention. Thus, it is apparent that the present general inventive concept can be carried out without those defined matters. Also, well-known functions or constructions are not described in detail since they would obscure the present general inventive concept in unnecessary detail.

Figure 2:
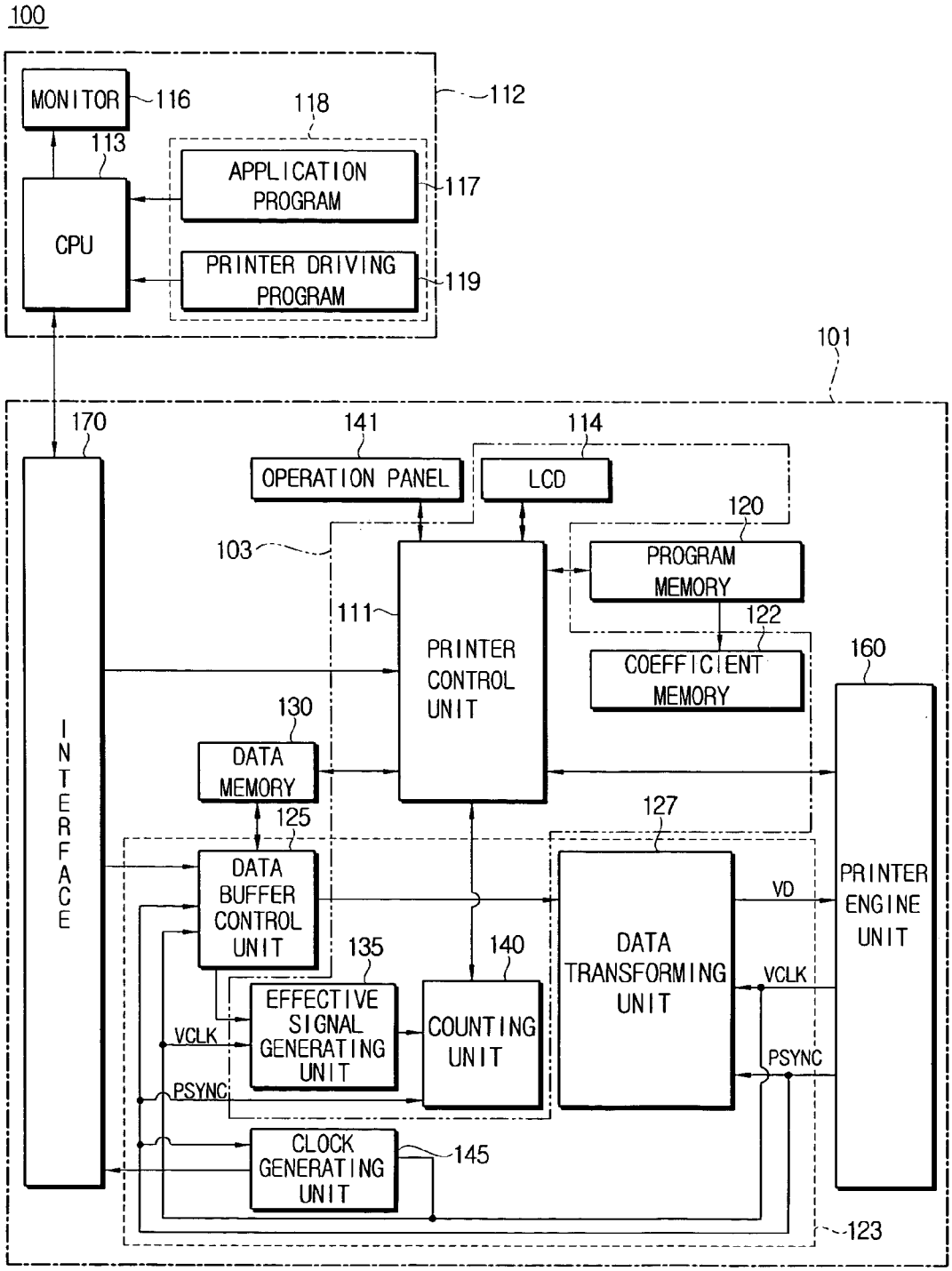
FIG. 2 is a block diagram of a printing system employing an apparatus to measure toner consumption according to an embodiment of the present general inventive concept.

FIG. 2 illustrates a printing system 100 employing a toner consumption measuring apparatus 103 according to an embodiment of the present general inventive concept.

As shown, the printing system 100 according to FIG. 2 includes a computer 112 which displays data of the user-prepared document through a monitor 116 and transmits it externally, and an image forming apparatus 101, such as a laser beam printer, which internally processes the data received from the computer 112 via an interface 170 to perform a corresponding printing operation.

The computer 112 includes a program memory 118, which stores therein an application program 117 to write documents and a printer driving program 119 to drive the printer 101, a central processing unit (CPU) 113 which drives the programs 117 and 119 of the program memory 118, and the monitor 116 which displays documents written through the computer 112.

The image forming apparatus 101 includes the interface 170 which constitutes a connection between the laser beam printer 101 and the computer 112 for data transmission and reception, an operation panel 141 to input a user command and a user selection, a program memory 120 which stores therein a variety of control programs required to perform the printer driving, a data memory 130 which stores therein various data generated in the execution of the control programs and also the printing data transmitted through the interface 170, a printer control unit 111 which controls the respective parts of the printer 101 by executing the control programs, a printer engine unit 160 which drives the printer mechanism under the control of the printer control unit 111, a data control unit 123 which outputs the printing data to the printer engine unit 160 through the interface 170, and a toner consumption measuring apparatus 103 which measures the toner consumption according to the present embodiment.

The program memory 120 can be constructed in a software manner, and may include a non-volatile flash memory capable of writing/erasing based on the sector unit. The data memory 130 may include a volatile memory, such as a random access memory (RAM), also capable of writing/erasing.

The printer engine unit 160 generates a video clock signal (VCLK) and a printer synchronous signal (PSYNC) and applies the same to a data transforming unit 127 of the data control unit 123.

The data control unit 123 may include a data buffer control unit 125, a clock generating unit 145 and the data transforming unit 127.

The data buffer control unit 125 can store the printing data from the computer 112 via the interface 170 in the data memory 130 in accordance with the VCLK signal and PSYNC signal, which are applied from the printer engine unit 160, and can output the stored data to the data transforming unit 127.

The data transforming unit 127 receives the printing data from the data buffer control unit 125 and outputs the printing data as the video data 'VD' to the printer engine unit 160 bit by bit, in accordance with the VCLK and PSYNC signals.

The clock generating unit 145 receives the VCLK signal from the printer engine unit 160 and generates a clock signal to request the printing data from the computer 112.

According to an aspect of the present general inventive concept, the toner consumption measuring apparatus 103 includes an effective signal generating unit 135, such as an AND gate, and also includes a counting unit 140, a coefficient memory 122, and a printer control unit 111. The effective signal generating unit 135 receives the printing data from the data buffer control unit 125 together with the VCLK signal from the printer engine unit 160 for the synchronization of the printing data, and generates binary image data having a '0' or '1'-count effective signal. The counting unit 140 counts the count effective signal of the generated binary image data, and calculates the number of pixels of the printing data. The coefficient memory 122 is installed in the program memory 120. The printer control unit 111 determines a compensation coefficient for the image condition by using the differences of the number of pixels of the adjacent lines of the page being printed, and calculates the toner consumption with applying a proper weight corresponding to the compensation coefficient as determined.

Figure 3:
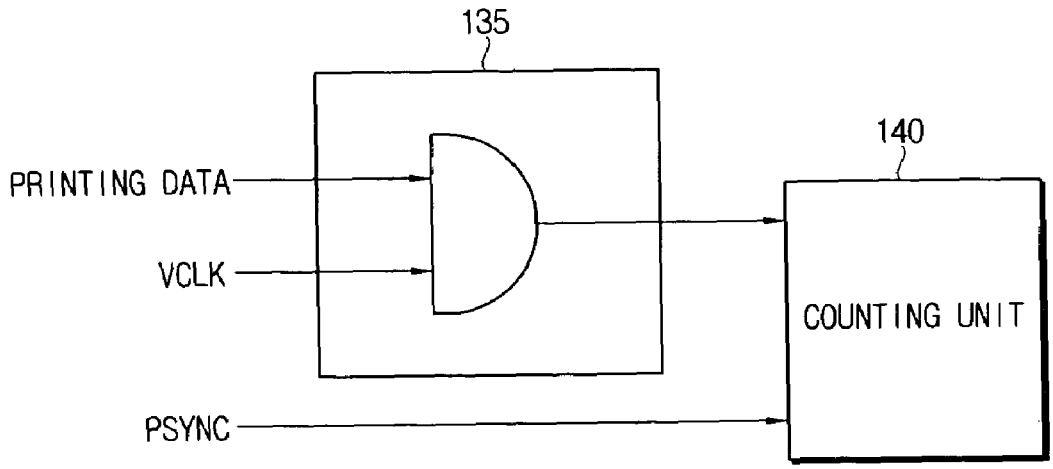
FIG. 3 is a block diagram of an effective signal generator of the toner consumption measuring apparatus of FIG. 2.
Figure 4:
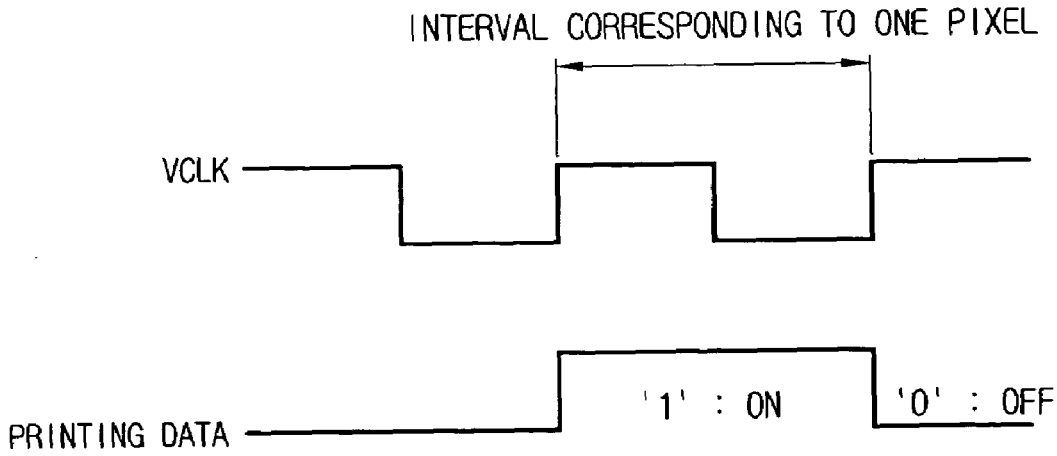
FIG. 4 illustrates waveforms of the printing data, and a video clock signal (VCLK) as a video data synchronous signal, both being inputted to the effective signal generator of the toner consumption measuring apparatus of FIG. 3.

As shown in FIGS. 3 and 4, the effective signal generating unit 135, which can be constructed of an AND gate, generates binary image data having a '0' or '1'-count effective signal in one VCLK cycle (interval), when the printing data of one pixel is inputted from the data buffer control unit 125.

The counting unit 140 counts the number of pixels, i.e., the number of '0' or '1'-count effective signals of the binary image data from the effective signal generating unit 135, and outputs the count signals to the printer control unit 111.

The coefficient memory 122 stores therein a predetermined toner consumption coefficient of a unit of pixel 'K'. The toner consumption coefficient 'K' may be adequately obtained by experiments, that is, by counting an actual amount of toner consumption for the printing of a variety of images under normal temperature and humidity through a general printer, which is set to a manufacturer's default values, and then dividing the counted actual toner consumption by the total number of pixels.

When printing on each page, the printer control unit 111 calculates an average 'A' of the differences of the number of pixels of the adjacent lines according to the number of pixels of a page 'Npixel', and determines the average 'A' of the pixel number differences of adjacent lines as a compensation coefficient for the image condition. Then, the printer control unit 111 calculates a first toner consumption of a page 'PTM1' by using the calculated average 'A' as a compensation coefficient to compensate a toner consumption of one page, which is calculated by the toner consumption coefficient of a unit of pixel 'K' stored in the coefficient memory 122, and by the number of pixels of a page 'Npixel' counted through the counting unit 140, and calculates a first toner consumption 'TM1' by accumulating 'PTM1'.

More specifically, the average 'A' of the pixel number differences of the adjacent lines of one page may be calculated by the following equation 1:

$$A = \frac{1}{M}\sum\frac{(NLpixel - N1Lpixel)}{Npixel} \quad (1)$$

where, 'NLpixel' is a number of pixels of the Nth line of a certain page,

'N1Lpixel' is a number of pixels of the (N+1)th line of the certain page,

'Npixel' is a number of pixels of a page, and

'M' is a number of adjacent lines of the certain page (total number of lines—1).

As mentioned above, the present applicant adopted the average 'A' of the pixel number differences of adjacent lines of one page as the compensation coefficient for toner consumption. This concept is based on the results of experiments, which indicate that the average 'A' is in precise proportion with the toner consumption varying in accordance with a variety of image patterns of the printing data. Therefore, the actual toner consumption can be sufficiently compensated by using the average 'A' of the pixel number differences of the adjacent lines of the printing page, and in accordance with the respective image patterns of the printing data, such as a solid pattern, character pattern and halftone pattern.

TABLE 2

| | Average (A) | | | |
|---|---|---|---|---|
| | 0~0.1 | 0.1~0.5 | 0.6~0.9 | 0.9~1 |
| Image pattern | Solid pattern | Character pattern similar to solid pattern | Character pattern similar to halftone | Halftone pattern |

'PTM1', the toner consumption of a page, can be obtained by the following equation 2:

$$PTM1 = N\text{pixel} \times K \times A \quad (2)$$

where, 'Npixel' is a number of pixels of a page,

'K' is a coefficient of toner consumption of a unit of pixel, and

'A' is an average of differences of the number of pixels of adjacent lines according to the number of pixels of a page 'Npixel'.

Accordingly, the first toner consumption 'TM1' can be calculated by the following equation 3:

$$TM1 = \Sigma PTM1 \quad (3)$$

The toner consumption measuring apparatus 103 in this case may further include displays 114 and 116, which display the first toner consumption 'TM1' and a usable toner reference in accordance with the display signal of the printer control unit 111.

The displays 114 and 116 each include a monitor, such as the monitor 116 of the external computer 112 as illustrated, or the liquid crystal display (LCD) 114 arranged near to the operation panel 141 of the printer 101.

As described above, the toner consumption measuring apparatus 103 according to the embodiment of FIG. 2 obtains an average 'A' of the differences of the number of pixels of the adjacent lines according to the number of pixels of a page 'Npixel', with 'Npixel' varying in accordance with the image pattern of the printing data, and uses the obtained average 'A' as a coefficient to compensate for the toner consumption of a page 'PTM1', which is calculated using the toner consumption coefficient of a unit of pixel 'K' and the number of pixels of a page. As a result, error in the measurement of toner consumption due to differing image pattern can be prevented, and toner consumption can be estimated very close to the actual toner consumption.

The toner consumption measuring method of the printing system 100 having the toner consumption measuring apparatus 103 according to FIG. 2 will now be described below, mainly with reference to FIGS. 2 and 5.

First, in accordance with the user input through the operation panel 141, or with the command from the computer 112, the printer control unit 111 applies a print, or a copy command to the printer engine unit 160, and accordingly, the printer engine unit 160 generates a print synchronous signal 'PSYNC' at operation S1A.

When the printer engine unit 160 generates the 'PSYNC', the data buffer control unit 125 and the counting unit 140 are reset, and the clock generating unit 145 generates a request clock signal to print data.

In accordance with the request clock signal of the clock generating unit 145 to print data, the data buffer control unit 125 stores in the data memory 130 the incoming printing data which is synchronized to the request clock, and outputs the data to the effective signal generating unit 135 and the data transforming unit 127.

When the data buffer control unit 125 outputs the printing data, the data transforming unit 127 outputs the printing data as the video data 'VD' bit by bit to the printer engine unit 160 in accordance with the 'VCLK' and 'PSYNC' signal, and the printer engine unit 160 emits through a laser diode of a laser scanning unit (not shown) a laser beam corresponding to the VD for the printing.

Referring to FIG. 4, the effective signal generating unit 135 generates binary image data having '0' or '1'-count effective signal in one 'VCLK' signal, when the printing data of one pixel is inputted.

Figure 5:
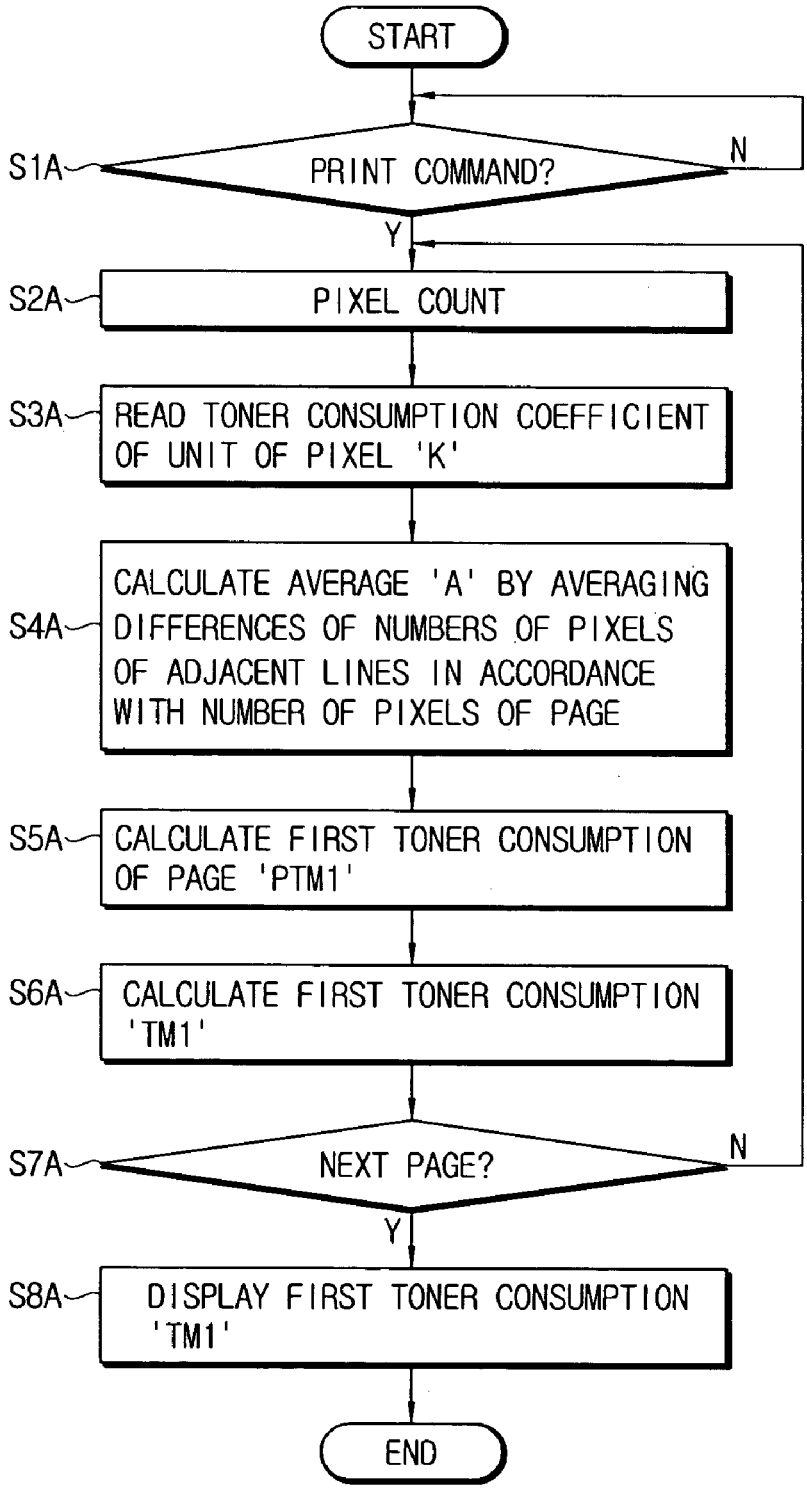
FIG. 5 is a flowchart illustrating an exemplary process of measuring toner consumption in the printing system of FIG. 2.

The counting unit 140 counts the number of '0' or '1'-count effective signals, i.e., the number of pixels of the binary image data outputted from the effective signal generating unit 135, and outputs the counted signals to the printer control unit 111, at operation S2A of FIG. 5.

When the count signals are received, the printer control unit 111 reads the toner consumption coefficient of a unit of pixel 'K' which is stored in the coefficient memory 122, at operation S3A.

At the same time, the printer control unit 111 updates and stores the updated number of pixels of the printing data corresponding to the counted signals, and calculates in the printing of each page, an average 'A' of differences of the number of pixels of the adjacent lines according to the number of pixels of a page 'Npixel' according to the above equation (1), in operation S4A.

Next, according to the above equation (2), which uses the average 'A' obtained from S4A to compensate for the toner consumption, which is calculated with the values obtained in S3A including the toner consumption coefficient of a unit of pixel 'K' and the number of pixels of a page 'Npixel', the printer control unit 111 calculates toner consumption of a page 'PTM1' at operation S5A.

Next, according to the above equation (2), which uses the average 'A' obtained from S4A to compensate for the toner consumption, which is calculated with the values obtained in S3A including the toner consumption coefficient of a unit of pixel 'K' and the number of pixels of a page 'Npixel', the printer control unit 111 calculates toner consumption of a page 'PTM1' at operation S6A.

Next, it is determined whether there is any printing, or copy data left for the next page at operation S7A, and if so, operations are repeated starting from operation S2A.

If there is no printing, or copy data as a result of the determination in S7A, the printer control unit 111 compares and checks the first toner consumption 'TM1' with the usable toner reference, and accordingly generates a display signal. According to the display signal of the printer control unit 111, the display unit 111 of the printer 101 and/or the monitor 116 of the computer 112 displays the first toner consumption 'TM1' and the usable toner reference at operation S8A, and completes the toner consumption measurement.

Figure 6:
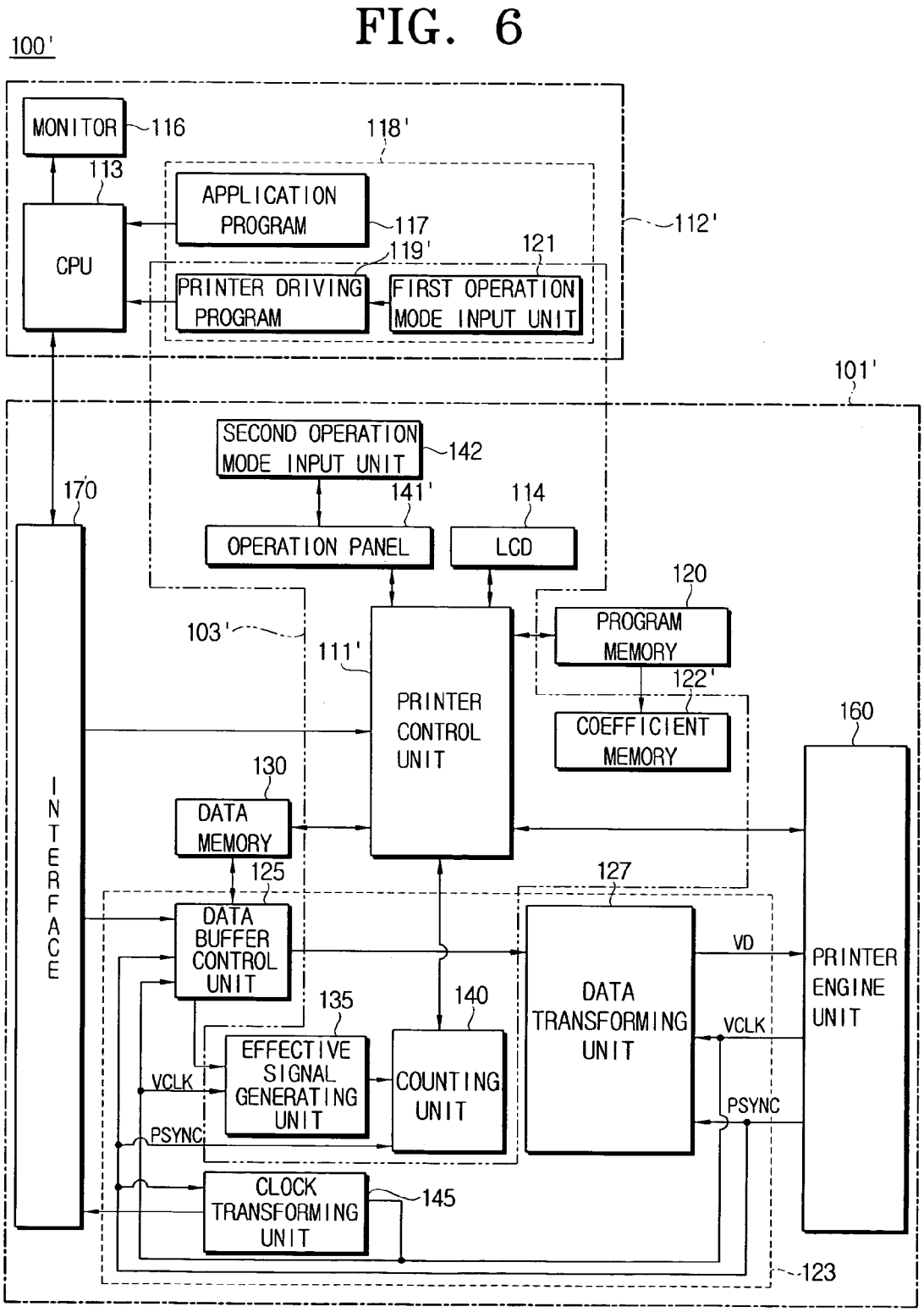
FIG. 6 is a block diagram of a printing system employing an apparatus to measure toner consumption according to another embodiment of the present general inventive concept.

FIG. 6 shows a printing system 100' which adopts a toner consumption measuring apparatus 103' according to another embodiment of the present general inventive concept.

Except for the toner consumption measuring apparatus 103', the printing system according to FIG. 6 has substantially the same construction as that of the printing system 100 having the toner consumption measuring apparatus 103 according to the previous embodiment. Therefore, the toner consumption measuring apparatus 103' will only be described hereafter, while the description of other parts illustrated in FIG. 6 will be omitted for the sake of brevity.

The toner consumption measuring apparatus 103' according to the embodiment of FIG. 6 includes an effective signal generating unit 135 such as an AND gate, and also includes a counting unit 140, a coefficient memory 122' and a printer control unit 111'. The effective signal generating unit 135 receives printing data from the data buffer control unit 125 and a video clock signal 'VCLK' from the printer engine unit 160 for the synchronization of the printing data, and generates binary image data having a '0' or '1'-count effective signal. The counting unit 140 counts the count effective signals of the generated binary image data, and calculates the number of pixels of the printing data. The coefficient memory 122' is installed in the program memory 120. The printer control unit 111' determines a compensation coefficient for image condition, using the mode of the printing operation and the difference of the number of pixels of the adjacent lines of one page, and calculates the toner consumption by applying appropriate weight in accordance with the compensation coefficient as determined.

The effective signal generating unit 135 and the counting unit 140 are similar to those described in the previous embodiment (FIGS. 3 and 4), and therefore, a detailed description thereof will be omitted for the sake of brevity.

Unlike the previous embodiment, the coefficient memory 122' according to the present embodiment of the general inventive concept further stores therein a plurality of image pattern compensation coefficients 'Kf', in addition to the toner consumption coefficient of a unit of pixel 'K', which is set to an optimum value based on experiments. The stored coefficients 'Kf' are used by the printer control unit 111' as the image condition compensation coefficient for the calculation of toner consumption.

The image pattern compensation coefficients 'Kf' are predetermined in accordance with the image patterns, which in turn are determined in accordance with the average 'A' of the differences of the number of pixels of the adjacent lines according to the number of pixels of a page 'Npixel'. The average 'A' is obtained according to the operation mode and the above-mentioned equation (1).

More specifically, the operation modes for the determination of image pattern compensation coefficients 'Kf' include a print mode and copy mode, and the copy mode includes sub-modes such as text item, text-photo item and photo item.

In accordance with the operation mode and the average 'A', the image patterns are determined as listed below in the table 3, and the image pattern compensation coefficients 'Kf' corresponding to the respective image patterns are set to optimum values according to experiments.

TABLE 3

| Operation mode/ average A | | 0~0.1 | 0.1~0.5 | 0.6~0.9 | 0.9 or higher |
|---|---|---|---|---|---|
| Print mode | | Solid pattern | Character pattern similar to solid pattern | Character pattern similar to halftone pattern | Halftone pattern |
| Copy mode | Text | Solid pattern | Character pattern similar to solid pattern | Character pattern similar to halftone pattern | Halftone pattern |
| | Text-photo | Solid pattern | Character pattern similar to solid pattern | Character pattern similar to halftone pattern | Halftone pattern |
| | photo | Solid pattern | Character pattern similar to solid pattern | Character pattern similar to halftone pattern | Halftone pattern |

When the image pattern is determined based on the operation mode and the average 'A', the printer control unit 111' determines one of the plurality of image pattern compensation coefficients 'Kf' as the image condition compensation coefficient, and uses the selected pattern compensation coefficient 'Kf' to compensate for the toner consumption which is calculated based on the total number of pixels of one page of printing data and the toner consumption coefficient of a unit of pixel 'K', and therefore, calculates the second toner consumption of a page 'PTM2'. The printer control unit 111' then accumulates 'PTM2' to obtain a second toner consumption 'TM2'.

'PTM2', the second toner consumption of a page can be calculated by the following equation 4:

$$PTM2 = N\text{pixel} \times K \times Kf \quad (4)$$

where, 'Npixel' is the number of pixels of a page,

'K' is a toner consumption coefficient of a unit of pixel, and

'Kf' is an image pattern compensation coefficient.

The second toner consumption 'TM2' can be obtained by the following equation 5:

$$TM2 = \Sigma PTM2 \quad (5)$$

First and second operation mode input units 121 and 142, respectively, are further provided for the input of the operation mode from the printer driving program 119' of the external computer 112' and the operation panel 141' of an image forming apparatus 101' so that the printer control unit 111' can select one among the plurality of image pattern compensation coefficients "Kf".

The first and the second operation mode input units 121 and 142, respectively, may each include a printer mode button (not shown) for the selection of print mode, and a copy mode button (not shown) for the selection of copy mode. The copy mode button may further include sub-mode selection tabs such as a text tab (not shown), a text-photo tab (not shown) and a photo tab (not shown).

When the printer control unit 111' is in the print mode, for example, which performs the printing operation through the printer driving program 119' of the program memory 118', the printer control unit 111' selects one among the plurality of image pattern compensation coefficients 'Kf' in accordance with the information regarding the operation mode which is inputted through the first operation mode input unit 121. When the printer control unit 111' is in the copy mode, for example, which performs the printing operation through the control program of the program memory 120 of the printer 101', the printer control unit 111' selects one among the plurality of image pattern compensation coefficients 'Kf' in accordance with the information regarding the operation mode which is inputted through the second operation mode input unit 142.

As described above, the toner consumption measuring apparatus 103' according to the present embodiment obtains an image pattern compensation coefficient 'Kf' corresponding to the image pattern which is determined in accordance with the operation mode and the average 'A' of the differences of the number of pixels of the adjacent lines according to the total number of pixels of one page, and uses the obtained image pattern compensation coefficient 'Kf' as the compensation coefficient to compensate for the toner consumption which is calculated with the toner consumption coefficient of a unit of pixel 'K' and the number of pixels of a page. As a result, the present embodiment prevents erroneous measurement in toner consumption due to the varying operation mode and image pattern, and can produce a toner consumption estimation which is closer to the actual toner consumption than the estimation made by conventional systems such as the one illustrated in FIG. 1.

The toner consumption measuring method of the printing system 100' employing the toner consumption measuring apparatus 103' according to the present embodiment will now be described below with reference to FIGS. 6 and 7.

First, in accordance with the user input through the operation panel 141', or the command from the computer 112', the operations S1B through S4B, which are identical to those at operation S1A through operation S4A in the previous embodiment (FIG. 5), are performed.

When each page is printed, after calculating the average 'A' of the differences of the number of pixels of the adjacent lines of the page according to the number of pixels of a page 'Npixel' in operation S4B, the printer control unit 111' determines the operation mode, which is inputted through either the first operation mode input unit 121 of the printer driving program 119' stored in the program memory 118' of the computer 112', or the second operation mode input unit 142 of the operation panel 141', and accordingly determines whether the current operation mode is the print mode, or one of the sub-operation modes of the copy mode, such as text-photo mode and photo-mode, at operations S5B, S5B', S5B''' and S5B''''.

After having determined the current operation mode, the printer control unit 111', as shown in the table 3 above, determines an image pattern for one currently-printing page which is printed in accordance with the average 'A' of operation S4B and the current operation mode determined in operations S5B, S5B', S5B'' and S5B'''' and reads out an image pattern compensation coefficient 'Kf' from the coefficient memory 122' based on the image pattern as determined, in operations S6B, S6B', S6B'' and S6B'''.

After that, the printer control unit 111' in operation S7B calculates the second toner consumption of a page 'PTM2' using the equation 4 above, and in accordance with the image pattern compensation coefficient 'Kf' read from the coefficient memory 122', the toner consumption coefficient of a unit of pixel 'K' read out in operation S3B, and the number of pixels of a page 'Npixel' which is counted by the counting unit 140.

Next, the printer control unit 111' calculates the second toner consumption 'TM2' by obtaining the sum of the second toner consumption 'PTM2' of one certain page and the second toner consumption 'PTM2' of the previous page which is stored in the data memory 130, and stores the calculated second toner consumption 'TM2' in the memory 130, at operation S8B.

It is then determined whether there is print or copy data left for the next page in operation S9B, and if so, the processes after the operation S2B are repeated.

If it is determined that there is no print or copy data left for the next printing page in the operation S9B, the printer control unit 111' compares and analyzes the second toner consumption 'TM2' with a reference value, and generates a display signal. According to the display signal as generated from the printer control unit 111', the display 114 of the printer 101' and/or the monitor 116 of the computer 112' display the second toner consumption 'TM2' and the reference value at operation SLOB, and ends the toner consumption measuring operation.

Figure 8:
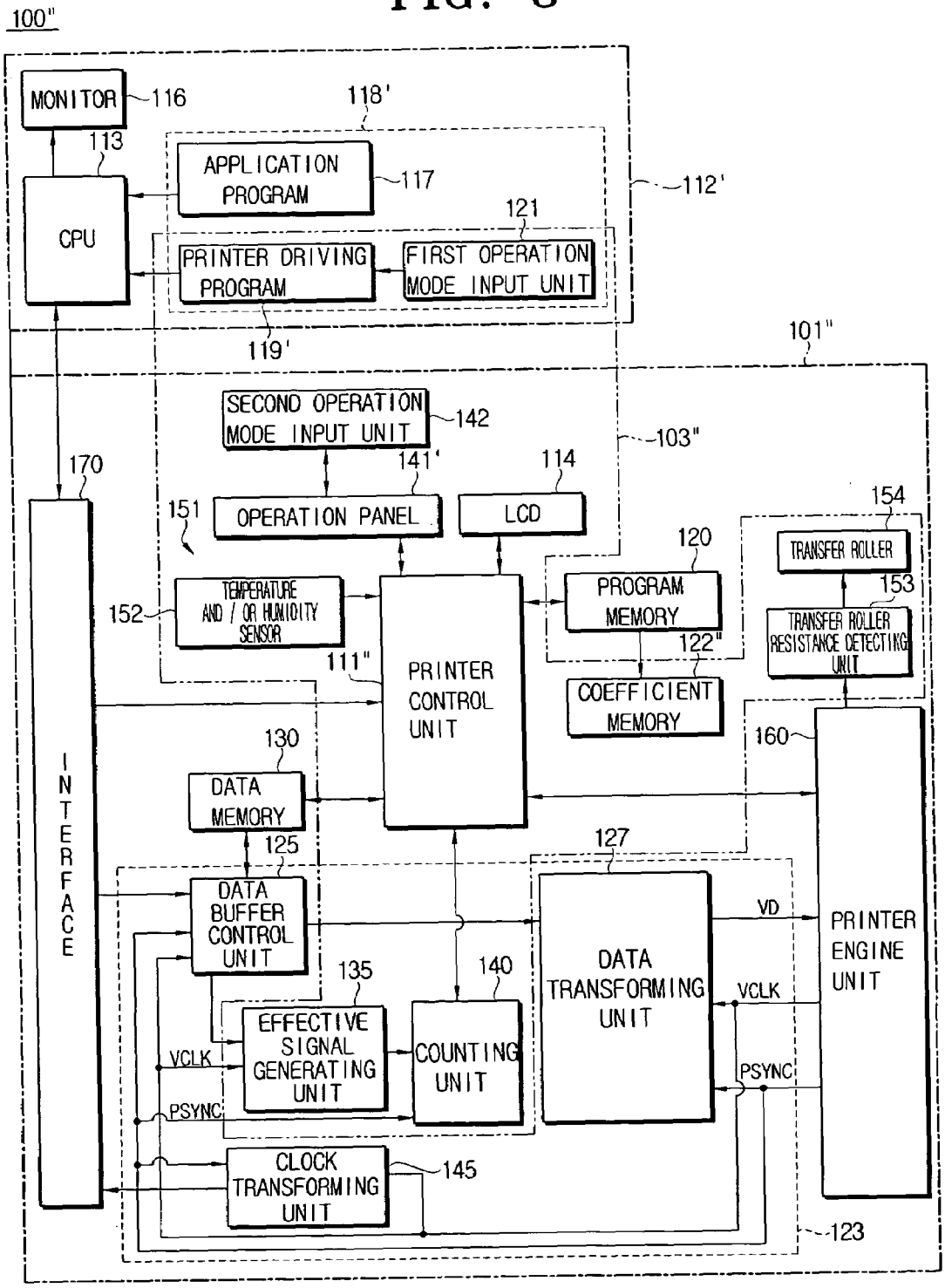
FIG. 8 is a block diagram of a printing system employing an apparatus to measure toner consumption according to yet another embodiment of the present general inventive concept.

FIG. 8 shows a printing system 100" having a toner consumption measuring apparatus 103" according to another embodiment of the present general inventive concept.

The image forming apparatus 100" according to the embodiment of FIG. 8 has a similar structure as that of the printing systems of the embodiments of FIG. 2 and FIG. 6, except for a toner consumption measuring apparatus 103" employed therein. Accordingly, description of similar elements and structures will be omitted for the sake of brevity, and an emphasis will be made toward the toner consumption measuring apparatus 103".

According to the present embodiment, the toner consumption measuring apparatus 103" of FIG. 8 includes an effective signal generating unit 135, a counting unit 140, a coefficient memory 122" and a printer control unit 111". The effective signal generating unit 135, which can be in the form of an AND gate, receives inputs such as print data from a data buffer control unit 125 and a video clock signal (VCLK) for the synchronization of the print data, and generates binary image data having a '0' or '1'-count effective signal. The counting unit 140 counts the count effective signals of the generated binary image data, and calculates the number of pixels of the print data. The coefficient memory 122" can be installed in the program memory 120. The printer control unit 111" calculates a third toner consumption 'TM3' by applying an appropriate weight, the weight being determined in accordance with temperature-based environment conditions and an average 'A' of differences of the number of pixels among the adjacent lines according to the number of pixels of a page 'Npixel'. The average 'A' can be obtained by the equation 1 above, using the number of pixels per line which is counted as each page is printed.

The counting unit 140 and the effective signal generating unit 135 are structured and operate in the same manner as that of the embodiment of FIG. 2. Therefore, further description thereof will be omitted for the sake of brevity.

The coefficient memory 122" stores therein a toner consumption coefficient of a unit of pixel 'K', which is set to an optimum value based on experiments, a plurality of image pattern compensation coefficients 'Kf' preset in accordance with the image pattern which is determined in accordance with the average 'A' and the operation mode, and a plurality of environment compensation coefficients 'E' preset in accordance with the temperature-based environmental conditions.

The toner consumption coefficient of a unit of pixel 'K', and the image pattern compensation coefficients 'Kf' are identical to those of the embodiment illustrated in FIG. 6, and therefore, further description thereof will be omitted.

As mentioned above, the environment compensation coefficients 'E' are preset in accordance with the environmental conditions which may be categorized into a low-temperature and low-humidity state, a normal-temperature and normal-humidity state, and a high-temperature and high-humidity state, as listed in table 4 below.

TABLE 4

| | Temperature | | |
|---|---|---|---|
| | 10° C. or below | 10° C.~32° C. | 32° C. or above |
| Environmental conditions | Low-temperature/low-humidity | Normal-temperature/normal-humidity | High-temperature/high-humidity |
| Environment compensation coefficient 'E' | 0.8 | 1 | 1.2 |

The toner consumption measuring apparatus 103" is provided with an environmental condition detecting unit 151, so that the printer control unit 111" can obtain information to determine the environmental conditions fallen into one among the plurality of preset environment compensation coefficients 'E'.

The environmental condition detecting unit may be a temperature sensor 152 installed in a proper place of the laser beam printer 101" which is less susceptible to temperature change so as to determine whether the atmospheric temperature is within a predetermined temperature range for normal operation of the laser beam printer 101", for example, from −10° C. to 45° C.

Alternatively, the environmental condition detecting unit 151 may be a transfer roller resistance detecting unit 153 which can detect temperature based on resistance of an elastic layer of a transfer roller 154 to determine whether it is the temperature for normal operation of the transfer roller 154.

In the above description, the environmental condition detecting unit 151 was depicted as including a temperature sensor 152, so that the environment compensation coefficients 'E' are determined solely based on the detected temperatures. However, this is solely in order to reduce the manufacturing cost, and one will appreciate that, for more elaborated determination of the environmental conditions, the environmental condition detecting unit 151 may further include a humidity sensor and can determine the environment compensation coefficients 'E' also based on the detected humidity.

The printer control unit 111" calculates the third toner consumption of a page 'PTM3' using the image pattern compensation coefficient 'Kf' and the environment compensation coefficient 'E' as the compensation coefficient for the toner consumption of one page. The image pattern compensation coefficient 'Kf' is selected in accordance with the image pattern determined by the operation mode and the average 'A', and the environment compensation coefficient 'E' is selected in accordance with the temperature-based environmental condition determined according to the temperature detected by the environmental condition detecting unit 151. The printer control unit 111" then calculates the third toner consumption 'PM3' by accumulating the third toner consumption of a page 'PTM3'.

The third toner consumption of a page 'PTM3' is calculated by the following equation 6:

$$PTM3 = N\text{pixel} * K * Kf * E \quad (6)$$

where, Npixel is the number of pixels of a page,

K is a toner consumption coefficient of a unit of pixel,

Kf is an image pattern compensation coefficient, and

E is an environment compensation coefficient.

The third toner consumption 'TM3' is calculated by the following equation 7:

$$TM3 = \Sigma PTM3 \quad (7)$$

Alternatively, the printer control unit 111" may calculate another third toner consumption 'TM3'', which is similar to the third toner consumption 'TM3' described above. The printer control unit 111" calculates this similar third toner consumption of a page 'TM3'', by calculating a similar third toner consumption of a page 'PTM3'', which is similar to the third toner consumption of a page 'PTM3' by using the environment compensation coefficient 'E', which in turn is selected in accordance with the temperature detected from the environment condition detecting unit 151, as a compensation coefficient to compensate for the first toner consumption of a page 'PTM1' calculated as in the embodiment of FIG. 2, and then accumulating the calculated similar third toner consumption of a page 'PTM3''.

Alternatively, the printer control unit 111" may calculate the third toner consumption 'TM3' or a similar third toner consumption 'TM3'' by calculating, as in the toner consumption measuring apparatus 103 or 103' of the embodiments of FIGS. 2 and 6, the second or first toner consumption of a page 'PTM2' or 'PTM1', and obtaining the second or first toner consumption 'TM2' or 'TM1' based on the accumulation of the calculated second or first toner consumption of a page 'PTM2' or 'PTM1'. Accordingly, the printer control unit 111" may calculate the third toner consumption 'TM3' or similar third toner consumption 'TM3'' by using the environment compensation coefficient 'E' as the compensation coefficient to compensate for the second toner consumption 'TM2' or first toner consumption 'TM1' as the environment compensation coefficient 'E' is selected in accordance with the environmental conditions which are determined based on the temperature detected from the environment condition detecting unit 151.

As in the toner consumption measuring apparatus 103' of FIG. 6, the toner consumption measuring apparatus 103" in the present embodiment of FIG. 8 is also provided with first and second operation mode input units 121 and 142 respectively located at the printer driving program 119' of the computer 112' and the operation panel 141' of the printer 101" for the input of the operation modes, such that the printer control unit 111" can input information to select one among the plurality of image pattern compensation coefficients 'Kf'.

According to the present embodiment, the toner consumption measuring apparatus 103" calculates: i) the image pattern compensation coefficient 'Kf' corresponding to the image pattern which is determined in accordance with the average 'A', or in accordance with the average 'A' and the operation mode; and ii) the temperature-based environment compensation coefficient 'E', and uses i) and ii) as the compensation coefficient to compensate for the toner consumption which is calculated by the toner consumption coefficient of a unit of pixel 'K' and the number of pixels of a page. The toner consumption measuring apparatus 103" according to the present embodiment is particularly efficient in preventing errors in toner consumption measurement in accordance with varying image pattern and temperature, and additionally, can provide more accurate toner consumption than those conventional systems, such as the one illustrated in FIG. 1.

Figure 9A:
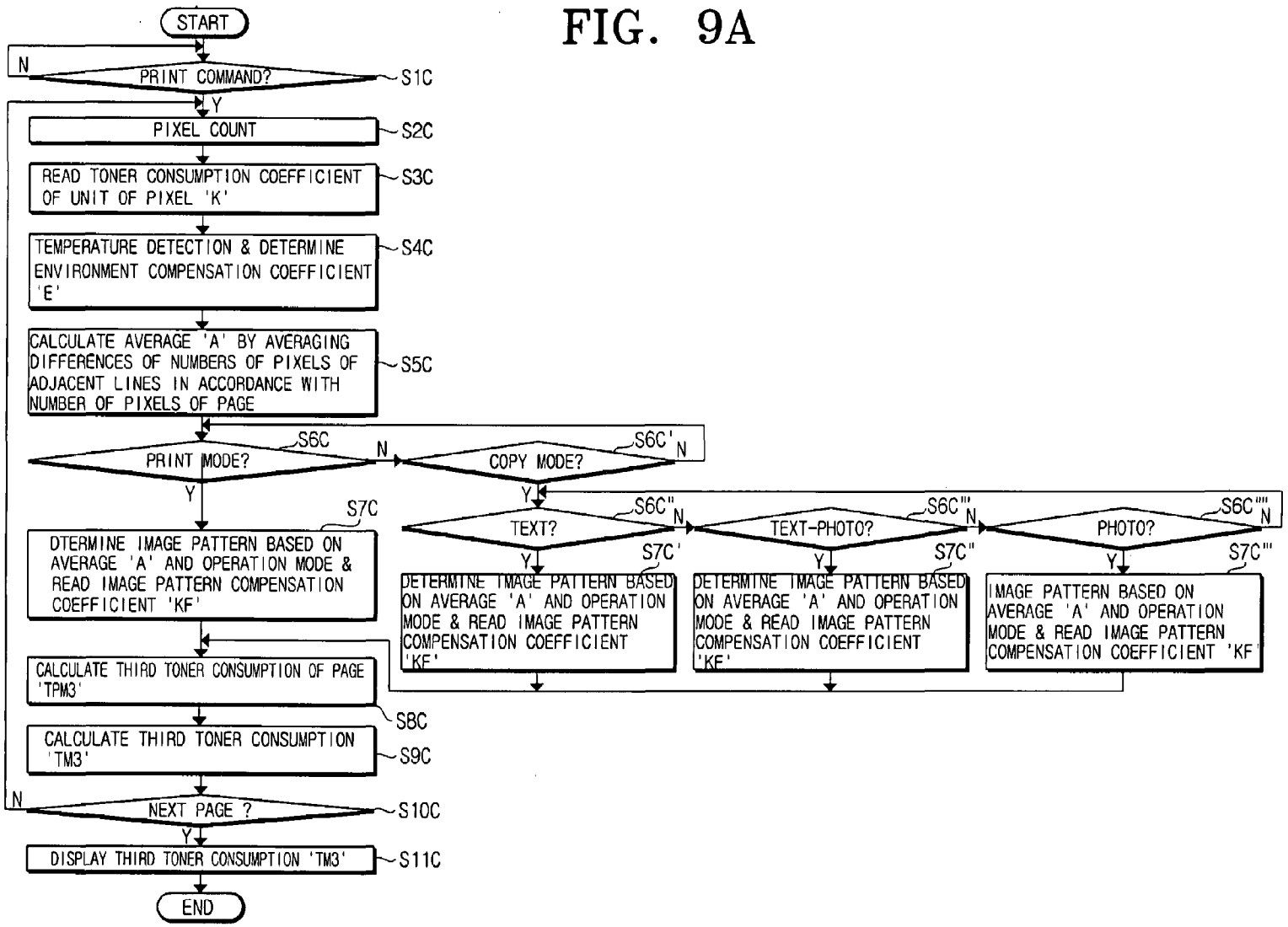
FIG. 9A is a flowchart illustrating an exemplary process of a toner consumption measuring method used with the printing system of FIG. 8.

Referring now to FIGS. 8 and 9A, the toner consumption measuring method of the toner consumption measuring apparatus 103" of the printing system 100" according to the present embodiment will be described below.

Figure 7:
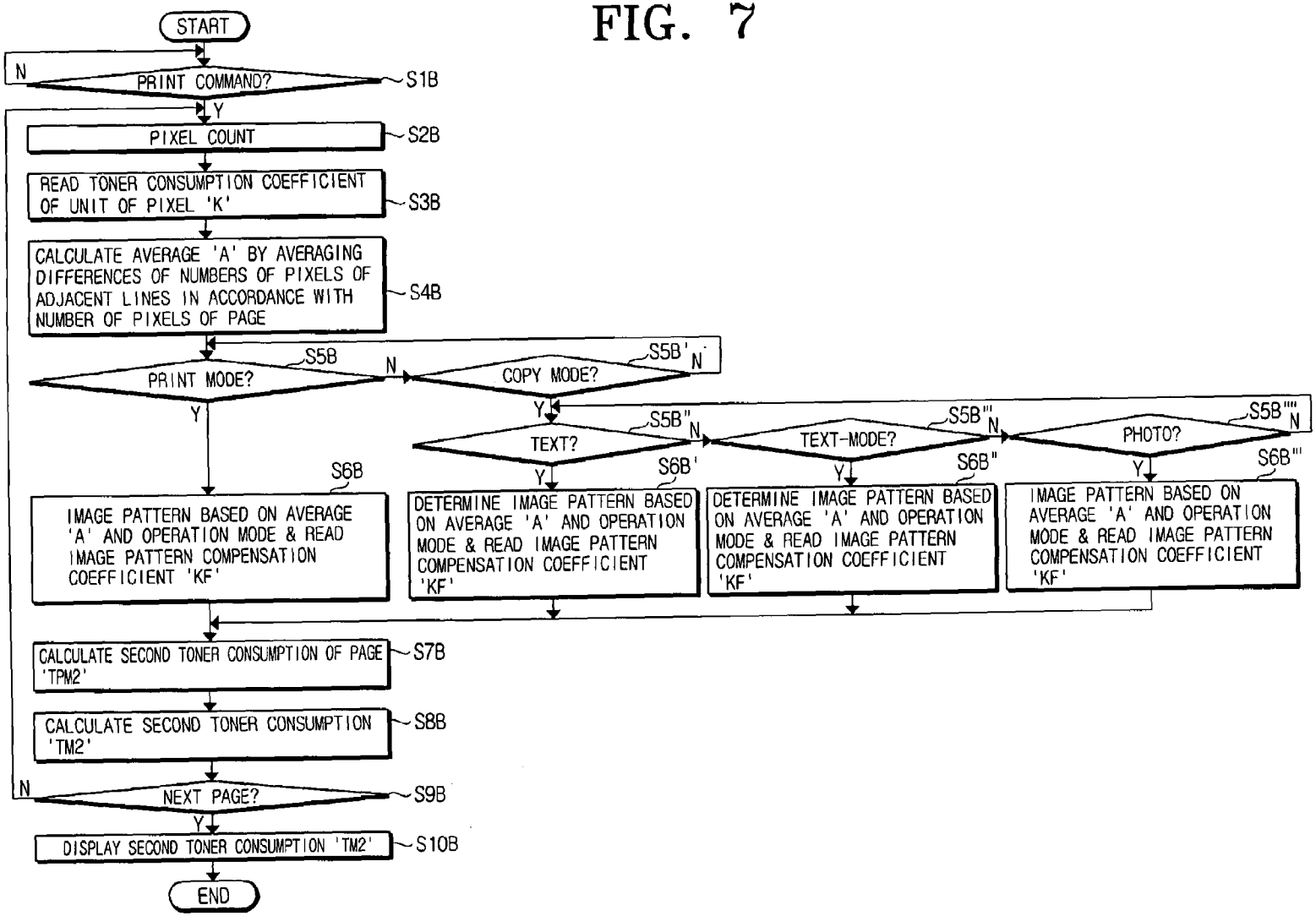
FIG. 7 is a flowchart illustrating an exemplary process of measuring toner consumption in the printing system of FIG. 6.

First, upon a user's input through the operation panel 141', or a command from the computer 112', operations S1C through S7C, S7C', S7C", and S7C'" are performed in a similar way as the toner consumption measuring operations S1B through S6B, S6B', S6B" and S6B'" according to the embodiment described in FIG. 7. The only difference is that the present embodiment further includes an operation S4C after an operation S3C of determining the environment conditions in accordance with the temperature detected through the environment condition detecting unit 151 and accordingly determining the environment compensation coefficient 'E'.

After reading the image pattern compensation coefficient 'Kf' from the coefficient memory 122" in the operations S7C, S7C', S7C" and S7C'", the printer control unit 111" in operation S8C calculates the third toner consumption of a page 'PTM3' according to the equation 6 above, using the read image pattern compensation coefficient 'Kf', the consumption coefficient of a unit of pixel 'K' read in operation S4C, the environment compensation coefficient 'E' determined in operation S3C, and the number of pixels of a page 'Npixel' which is counted through the counting unit 140. The image pattern compensation coefficient 'Kf' and the environment compensation coefficient 'E' are used as a compensation coefficient to compensate for the toner consumption which is calculated by using the consumption coefficient of a unit of pixel 'K' and number of pixels of a page 'Npixel'.

After that, the printer control unit 111" calculates the third toner consumption 'TM3' by adding the third toner consumption of a page 'PTM3' on a certain page with the third toner consumption of a page 'PTM3' on the page previous to the certain page stored in the data memory 130, and stores the sum in the data memory 130 at operation S9C.

Next, the printer control unit 111" determines whether there is printing or copy data left for the next page, and if so, repeats the operations after operation S2C.

If it is determined that there is no printing or copy data left in operation S10C, the printer control unit 111" compares and analyzes the third toner consumption 'TM3' with the reference toner usage, and accordingly generates a display signal. According to the display signal of the printer control unit 111", the display 114 of the printer 101" and/or the monitor 116 of the computer 112' displays the third toner consumption 'TM3' together with the reference toner usage in operation S11C, and ends the toner consumption measuring operation.

Figure 9B:
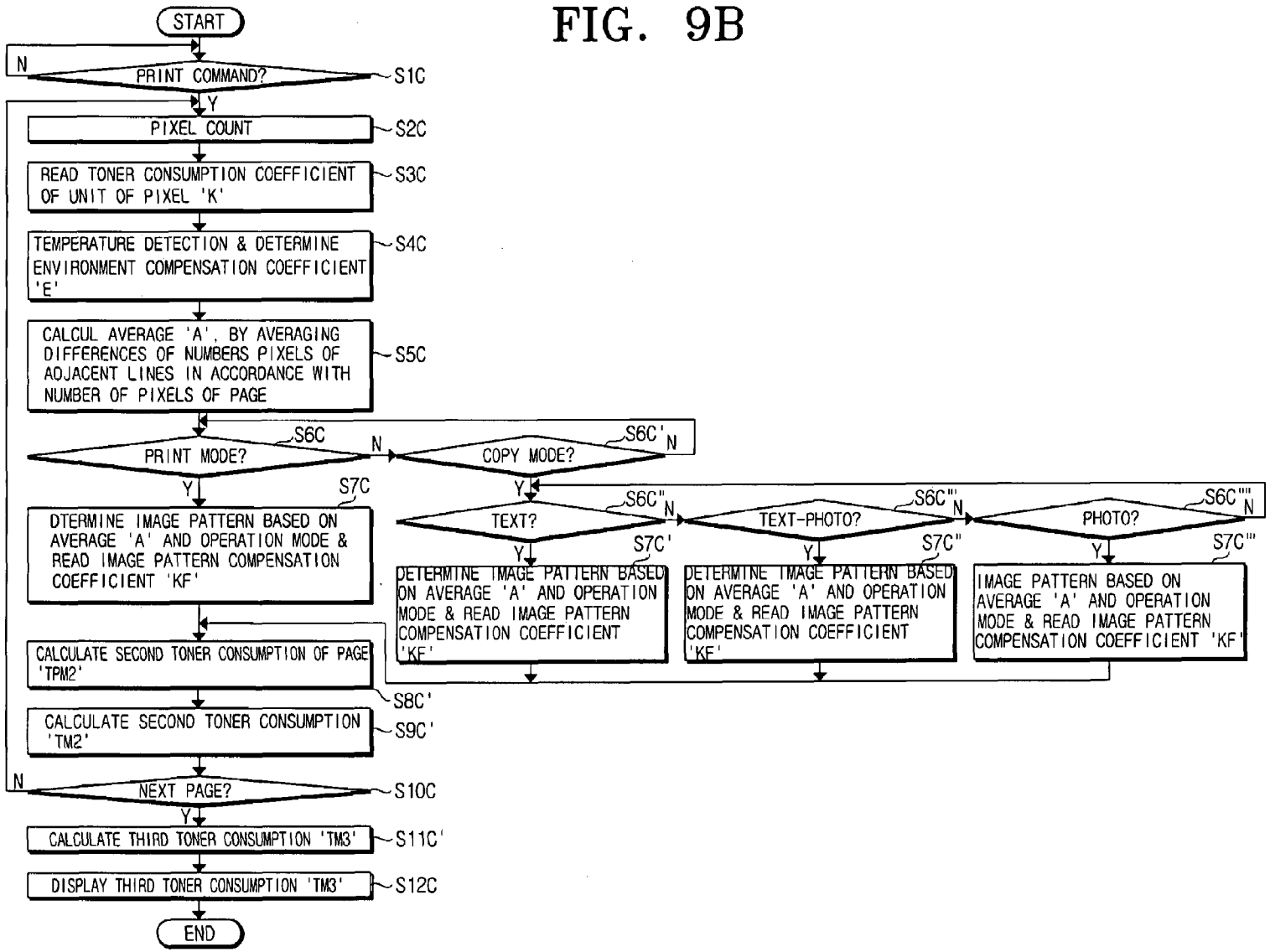
FIG. 9B shows a modified example of FIG. 9A.

FIG. 9B shows a modified example of the toner consumption measuring method according to the embodiment of FIG. 9A.

The toner consumption measuring operations S1C through S10C of the modified example are similar to the toner consumption measuring operations S1B through S9B of the embodiment described in FIG. 7, except that it further includes the operation S4C after the operation S3C, for determining the environment compensation coefficient 'E' according to the temperature detected through the environment condition detecting unit 151.

If it is determined that there is no printing or copy data left in operation S10C, the printer control unit 111" uses the environment compensation coefficient 'E' determined in operation S4C as the compensation coefficient to compensate for the second toner consumption 'TM2' calculated in the operation S9C, and therefore calculates the third toner consumption 'TM3' in operation S11C'.

After that, the printer control unit 111" compares and analyzes the third toner consumption 'TM3' with the reference toner usage, and accordingly generates a display signal. According to the display signal from the printer control unit 111", the display 114 of the printer 101" and/or the monitor 116 of the computer 112' displays the third toner consumption 'TM3' together with the reference toner usage in operation S12C, and ends the toner consumption measuring operation.

Figure 10:
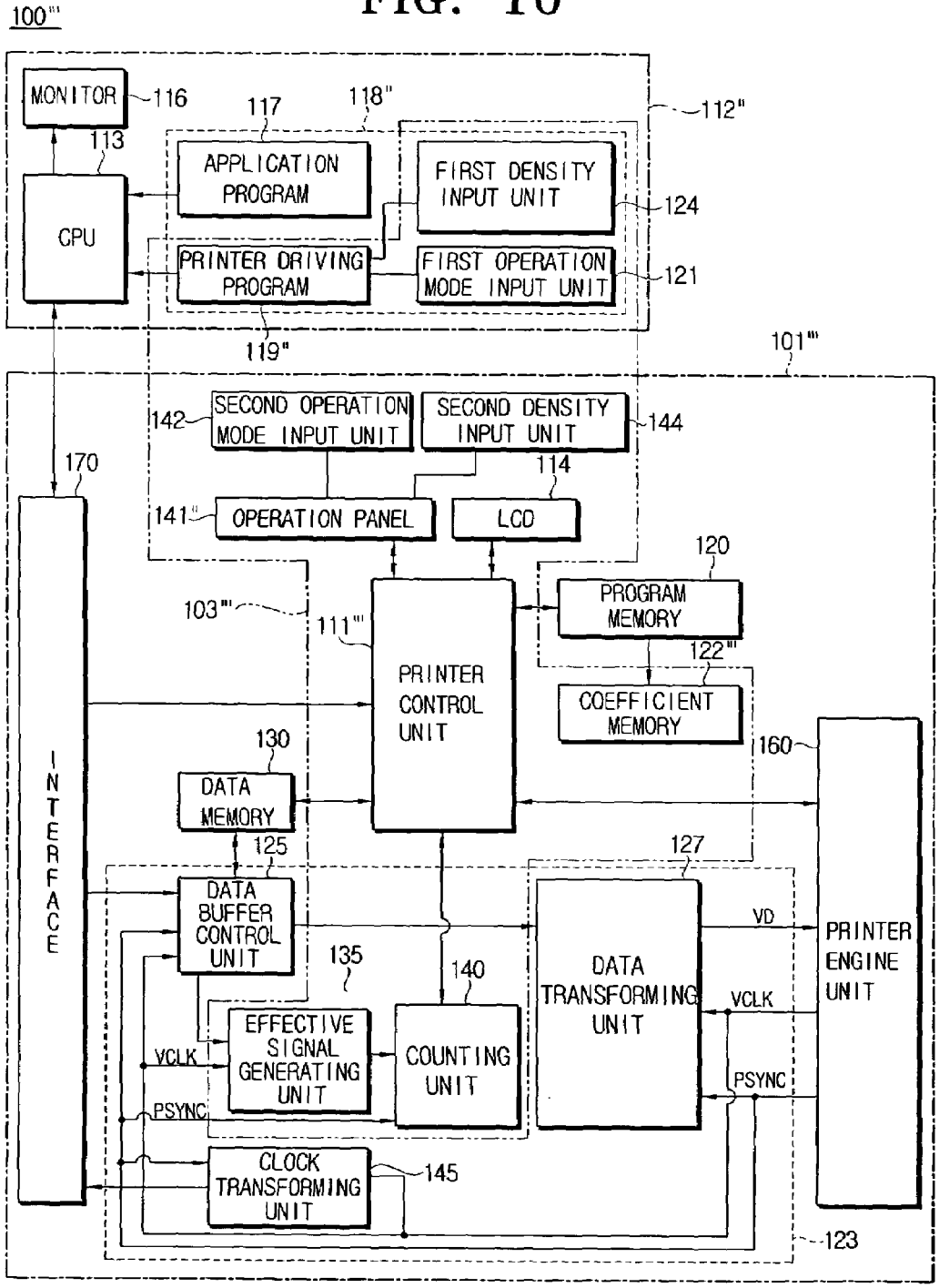
FIG. 10 is a block diagram of a printing system employing a toner consumption measuring apparatus according to yet another embodiment of the present general inventive concept.

FIG. 10 shows a printing system 100'" having the toner consumption measuring apparatus 103'" according to another embodiment of the present general inventive concept.

The image forming apparatus 100'" of FIG. 10 has the general constructions substantially similar to those of the embodiments illustrated in FIG. 2, 6 and 8, and therefore, description of like elements will be omitted for the sake of brevity, and the emphasis will be made on the toner consumption measuring apparatus 103'".

The toner consumption measuring apparatus 103'" according to the embodiment of FIG. 10 includes an effective signal generating unit 135 such as an AND gate, a counting unit 140, a coefficient memory 122'" and a printer control unit 111'". The effective signal generating unit 135, such as an AND gate, receives inputs of a printing data of the data buffer control unit 125 and a video clock signal 'VCLK' of a printer engine unit 160 for synchronization of the printing data, and generates the input data into binary image data having a '0' or '1'-count effective signal. The counting unit 140 counts the count effective signals of the binary image data, and therefore calculates the number of pixels 'Pixel' of the printing data. The coefficient memory 122'" can be installed in the program memory 120. The printer control unit 111'" calculates a fourth toner consumption 'TM4' by applying appropriate weight in accordance with an average 'A', the mode of operation, and the printing density for the printing data. The average 'A' is obtained by averaging the differences of numbers of the pixels of adjacent lines according to the number of pixels of a page 'Npixel' calculated according to the equation 1 above with the number of pixels per line which is counted in every printing of the pages.

The effective signal generating unit 135 is substantially the same as that of the toner consumption measuring apparatus 103 of the embodiment illustrated in FIGS. 3 and 4, and therefore, a detailed description thereof will be omitted for the sake of brevity.

The coefficient memory 122''' stores therein: a toner consumption coefficient of a unit of pixel 'K', which is set to optimum value according to experiments; a plurality of image pattern compensation coefficients 'Kf' which are preset in accordance with the image pattern based on the operation mode and the average 'A'; and a plurality of density compensation coefficients 'D' which are predetermined in accordance with the printing density for the printing data.

The toner consumption coefficients of a unit of pixel 'K' and the image pattern compensation coefficients 'Kf' are substantially the same as those stored in the coefficient memory 122' of the toner consumption measuring apparatus 103' of FIG. 6. Therefore, a detailed description thereof will be omitted for the sake of brevity.

The density compensation coefficients D are suitably predetermined, depending on the categories of printing density, such as light, mid and dark as listed in the table below:

| | Printing density | | |
|---|---|---|---|
| | Light | Mid | Dark |
| Density compensation coefficient 'D' | 0.8 | 1 | 1.2 |

One will appreciate that the density compensation coefficients 'E' may be classed into more diverse categories than the categories of 'Light', 'Mid' and 'Dark' printing densities as listed above.

In order for the printer control unit 111''' to select one among the plurality of density compensation coefficients 'D' stored in the coefficient memory 122''', input of the printing density information is required, and therefore, the toner consumption measuring apparatus 103''' further includes first and second density input units 124 and 144 respectively located at the printer driving program 119" of the program memory 118" of the computer 112" and the operation panel 141" of the laser beam printer 101'''.

The first and second density input units 124 and 144 may include a light-printing button (not shown), a normal-printing button (not shown) and a dark-printing button (not shown).

When the printing operation is carried out through the printer driving program 119" of the program memory 118" of the computer 112" as in the printing mode operation, the printer control unit 111''' selects one among the plurality of density coefficients 'D' in accordance with the printing density information inputted through the first density input unit 124. In contrast, when the printing operation is carried out through the control program of the program memory 120 of the printer 101''' as in the copy operation mode, the printer control unit 111''' selects one among the plurality of density compensation coefficients 'D' in accordance with the print density information inputted through the second density input unit 144.

The printer control unit 111''' calculates the fourth toner consumption of a page 'PTM4' by using an image pattern compensation coefficient 'Kf' and a density compensation coefficient 'D' as the compensation coefficient to compensate for the toner consumption of a page, and accumulates the fourth toner consumption of a page 'PTM4' to obtain a fourth toner consumption 'TM4'. The image pattern compensation coefficient 'Kf' is selected from the plurality of image pattern compensation coefficients 'Kf' determined in accordance with the image pattern based on the mode of operation and the average 'A', and the density compensation coefficient 'D' is selected according to the printing density information inputted through the first or the second density input unit 124 or 144.

The fourth toner consumption of a page 'PTM4' is calculated by the following equation 8:

$$PTM4=Npixel*K*Kf*D \quad (8)$$

where, 'Npixel' is the number of pixels of a page,

'K' is the toner consumption coefficient of a unit of pixel,

'Kf' is the image pattern compensation coefficient, and

'D' is the density compensation coefficient

The fourth toner consumption 'TM4' is calculated by the following equation 9:

$$TM4=\Sigma PTM4 \quad (9)$$

Alternatively, the printer control unit 111''' may use the density compensation coefficient 'D', which is selected according to the printing density information inputted through the first or the second density input unit 124 or 144, as a compensation coefficient to compensate for the first toner consumption of a page 'PTM1', which is calculated in the same manner as the printer control unit 111 of FIG. 2, so as to calculate a similar fourth toner consumption of a page 'PTM4'' which is almost similar to the fourth toner consumption of a page 'PTM4', accumulate the similar fourth toner consumptions 'PTM4'' and calculate a similar fourth toner consumption 'TM4'' which is very similar to the fourth toner consumption 'TM4'.

Or, alternatively, the printer control unit 111''' may calculate the second or first toner consumption of a page 'PTM2' or 'PTM1' in the similar way as in the toner consumption measuring apparatus 103' or 103 of FIG. 6 or FIG. 2, accumulate the second or the first toner consumption of a page 'PTM2' or 'PTM1', and therefore calculate the second or the first toner consumption 'TM2' or 'TM1'. Then the printer control unit 111''' may use the density compensation coefficient 'D', which is selected according to the printing density information inputted through the first or the second density input unit 124 or 144, as a compensation coefficient to compensate for the second or the first toner consumption 'TM2' or 'TM1', and therefore calculate the fourth toner consumption 'TM4' or a similar fourth toner consumption 'TM4''.

As in the toner consumption measuring apparatuses 103' and 103" of FIG. 6 and FIG. 8, input of necessary information is required in order for the printer control unit 111''' to select one among the plurality of image pattern compensation coefficients 'Kf', and therefore, the toner consumption measuring apparatus 103''' may further include first and second operation mode input units 121 and 142 respectively located at the printer driving program 119" of the computer 112" and the operation panel 141" for the input of the operation modes.

As described above, the toner consumption measuring apparatus 103''' according to the fourth embodiment of FIG. 10 uses, as a compensation coefficient to compensate for the toner consumption: i) the image pattern compensation coefficient 'Kf' corresponding to the image pattern which is determined according to the average 'A', or the average 'A' and the mode of the operation; and ii) the density compensation coefficient, which is determined according to the intended printing density, with the toner consumption being calculated according to the toner consumption coefficient of a unit of pixel 'K' and the number of pixels of a page. As a result, the present embodiment is particularly efficient in the prevention of errors in toner consumption measurement due to varying image pattern and printing density, and furthermore, can provide an estimate of toner consumption which is very close to the actual toner consumption.

The operation of the printing system 100''' having the toner consumption measuring apparatus 103''' according to FIG. 10, and the toner consumption measuring method thereof will be described below, particularly with reference to FIGS. 10 and 11A.

First, upon user's input on the operation panel 141'', or according to the command from the computer 112'', the operations S1D through S7D''' are performed in the same way as the operations S1B through S6B''' of the toner consumption measuring method of FIG. 7. The only exception is that the embodiment of FIG. 10 additionally includes the operation S4D after the operation S3D, to determine the density compensation coefficient 'D' in accordance with the printing density information inputted through the first or the second density input unit 124 or 144, respectively.

After reading the image pattern compensation coefficient 'Kf' from the coefficient memory 122''' in the operations S7D, S7D', S7D'', and S7D''', the printer control unit 111''' in operation S8D calculates a fourth toner consumption of a page 'PTM4', by using the read image pattern compensation coefficient 'Kf', the consumption coefficient of a unit of pixel 'K' read from the operation S3D, the density compensation coefficient 'D' determined in the operation S4D, and the number of pixels of a page 'Npixel' which is counted through the counting unit 140, and in accordance with the equation 8 above. The image pattern compensation coefficient 'Kf' and the density compensation coefficient 'D' are used as the compensation coefficient to compensate for the toner consumption, which is calculated with the consumption coefficient of a unit of pixel 'K' and the number of pixels of a page 'Npixel'.

Next, the printer control unit 111''' in operation S9D calculates a fourth toner consumption 'TM4' by adding the fourth toner consumption of a page 'PTM4' of one page and the fourth toner consumption 'PTM4' of the previous page stored in the data memory 130, and stores the calculated fourth toner consumption 'TM4' in the data memory 130.

After that, it is determined whether there is printing or copy data left for the next page in operation S10D, and if so, the operations after the operation S2D are repeated.

If it is determined that there is no printing or copy data left in operation S10D, the printer control unit 111''' compares and analyzes the fourth toner consumption 'TM4' with a reference toner usage, and accordingly generates a display signal. Accordingly, in operation S11D, the display 114 of the printer 101''' and/or the monitor 116 of the computer 112'' display the fourth toner consumption 'TM4' and the reference toner usage in accordance with the display signal, and the toner consumption measuring operation is ended.

Figure 11A:
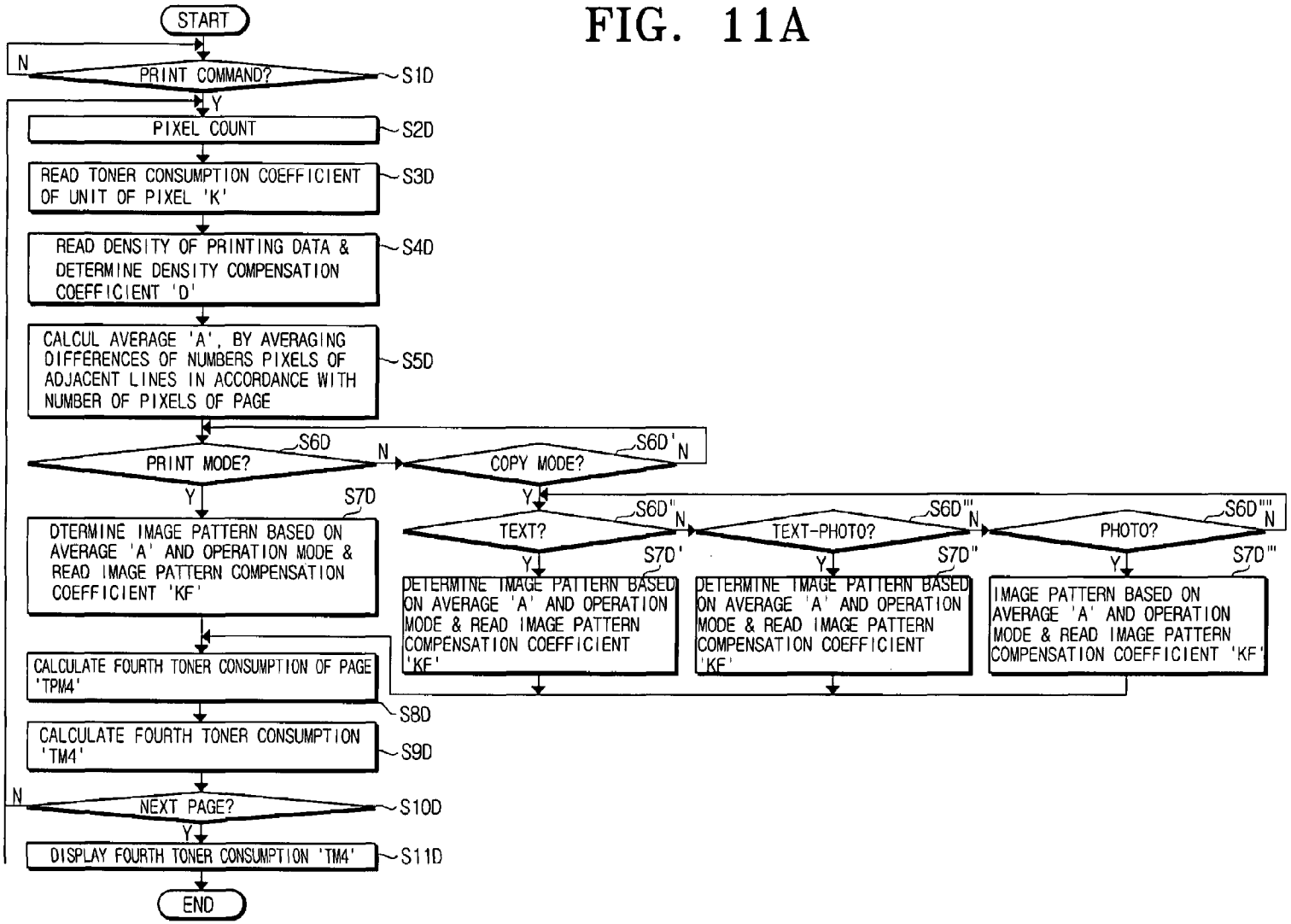
FIG. 11A is a flowchart illustrating an exemplary process of toner consumption measuring method used with the printing system of FIG. 10.
Figure 11B:
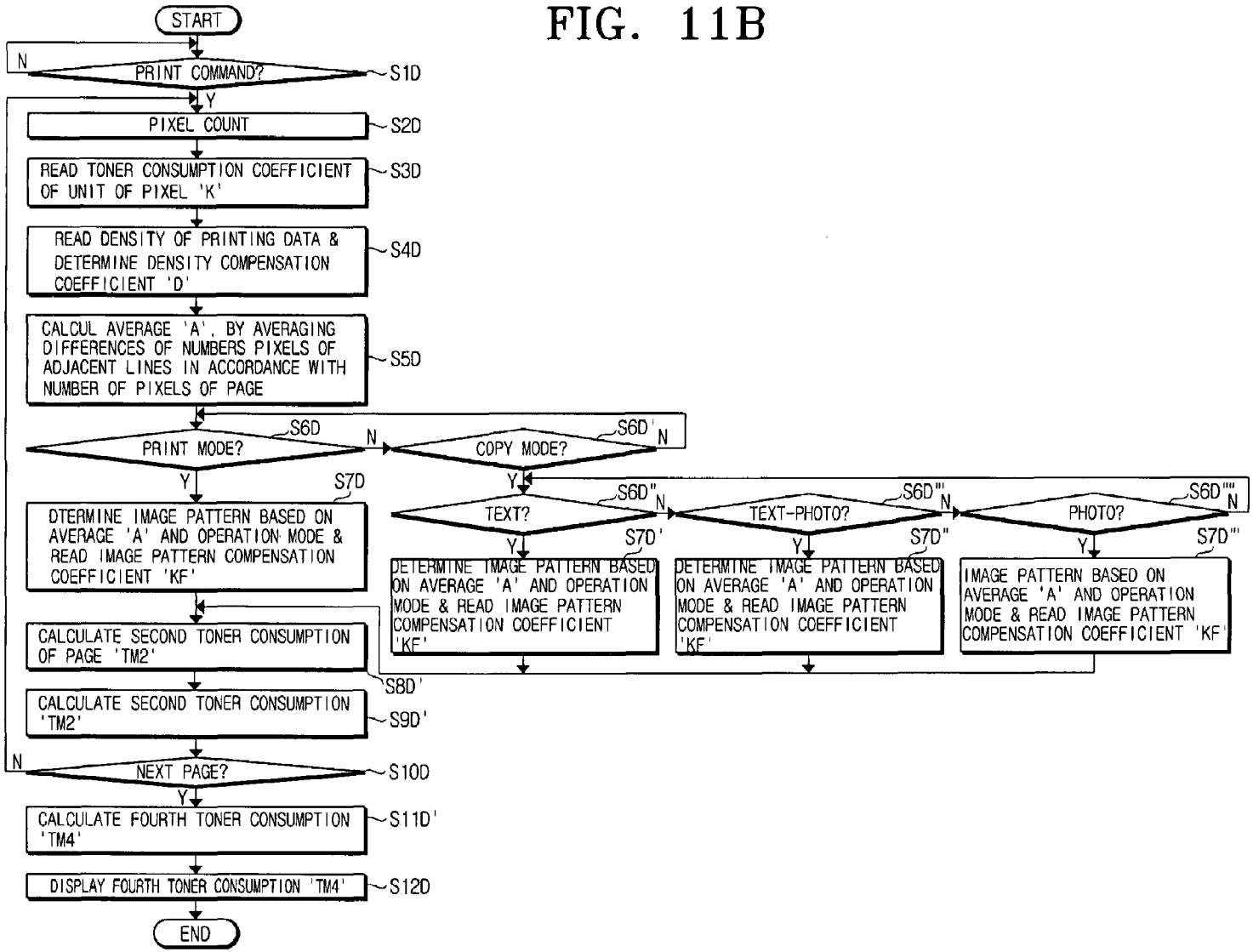
FIG. 11B shows a modified example of FIG. 11A.

FIG. 11B shows a modified example of the toner consumption measuring method used with the printing system of FIG. 10.

Operations S1D through S9D' of the modified example of the embodiment of FIG. 10 illustrated in FIG. 11B is similar to the embodiment of FIG. 6 in the operations of S1B through S9B (FIG. 7), while the only difference is the addition of the operation S4D after the operation S3D, to determine the density compensation coefficient 'D' according to the printing density information which is inputted through the first or the second density input unit 124 or 144.

If it is determined that there is no printing or copy data in operation S10D, the printer control unit 111''' in operation S11D' calculates the fourth toner consumption 'TM4' by using the density compensation coefficient 'D', which is determined in the operation S4D, as a compensation coefficient to compensate for the second toner consumption 'TM2' calculated in operation S9D'.

After this operation, the printer control unit 111''' compares and analyzes the fourth toner consumption 'TM4' with the reference toner usage, and accordingly generates a display signal, so that the display 114 of the printer 101''' and/or the monitor 116 of the computer 112'' can display the fourth toner consumption 'TM4' and the reference toner usage in accordance with the display signal in operation S12D. Then, the toner consumption measuring operation is completed.

Figure 12:
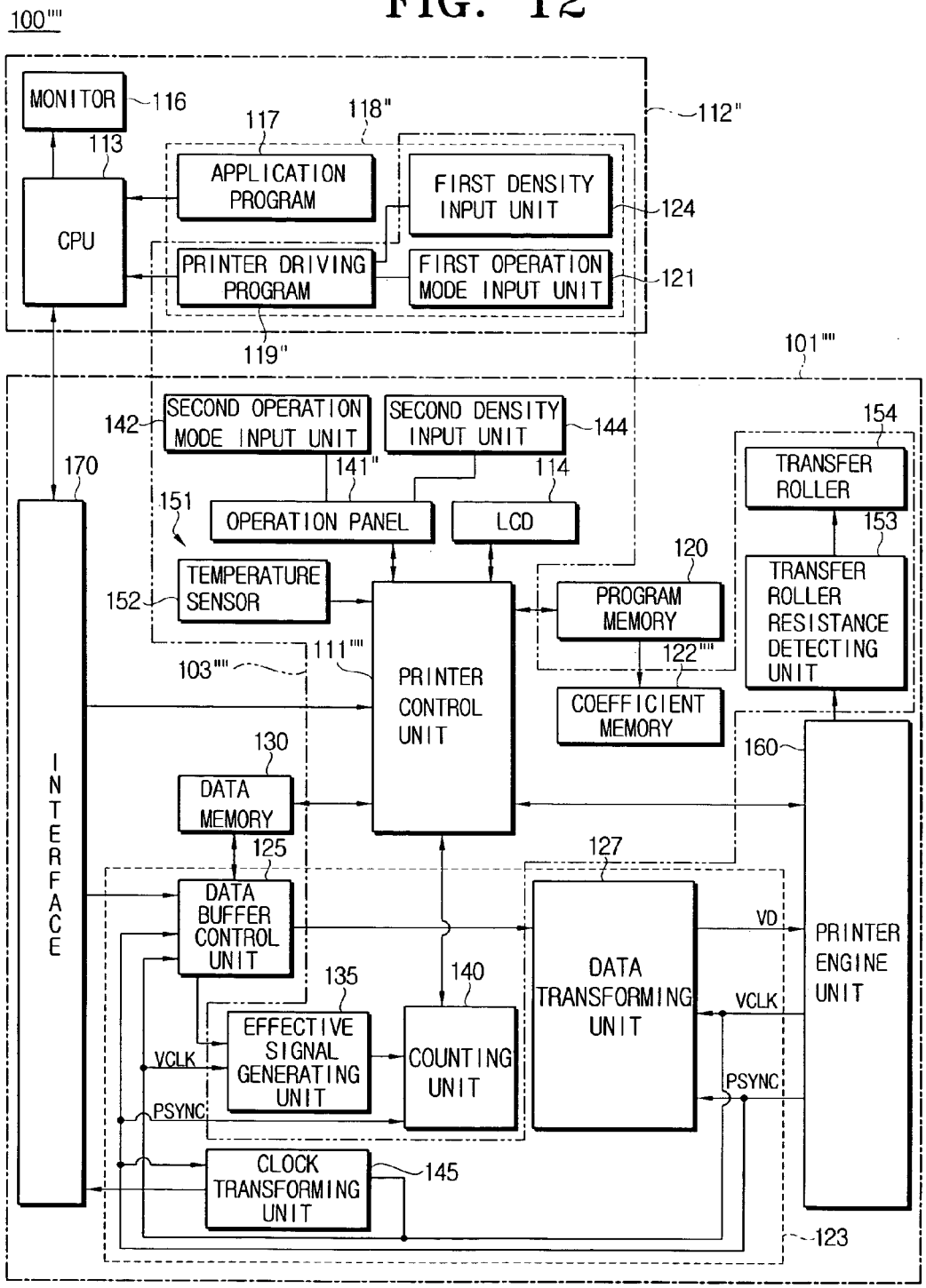
FIG. 12 is a block diagram of a printing system employing an apparatus to measure toner consumption according to still another embodiment of the present general inventive concept.

FIG. 12 shows a printing system 100'''' which has a toner consumption measuring apparatus 103'''' according to another embodiment of the present general inventive concept.

The printing system 100'''' of the fifth embodiment is substantially similar to the printing system 100, 100', 100'' and 100''' illustrated in the embodiments of FIGS. 2, 6, 8, and 10, respectively, in terms of construction, and the only difference lies in the toner consumption measuring apparatus 103''''. Therefore, description of the like elements or structures will be omitted as much as possible for the sake of conciseness.

According to the embodiment of FIG. 12, the toner consumption measuring apparatus 103'''' may include an effective signal generating unit 135 such as an AND gate, a counting unit 140, a coefficient memory 122'''' installed in the program memory 120, and a printer control unit 111''''. The effective signal generating unit 135, such as an AND gate, receives inputs of printing data from the data buffer control unit 125 and the video clock signal 'VCLK' of the printer engine unit 160 for the synchronization of the printing data, and generates the data into binary image data having a '0' or '1'-count effective signal. The counting unit 140 calculates the number of pixels 'Pixel' by counting the count effective signals of the binary image data. The printer control unit 111'''' calculates a fifth toner consumption 'TM5' by applying suitable weights in accordance with the average 'A', the mode of operation, the temperature-based environment condition, and the printing density. The average 'A' is obtained by averaging the differences of the numbers of the pixels of adjacent lines, according to the number of pixels of a page 'Npixel'. The average 'A' is calculated by using the number of pixels per line of one page, which is counted in the printing of every page, and in accordance with the equation 1.

The effective signal generating unit 135 and the counting unit 140 are substantially identically to those illustrated in FIGS. 3 and 4 used in the toner consumption measuring apparatus 103 of the embodiment illustrated in FIG. 2, and therefore, a detailed description thereof will be omitted for the sake of brevity.

The coefficient memory 122'''' stores therein: the toner consumption coefficient of a unit of pixel 'K', which is set to optimum values according to experiments; a plurality of image pattern compensation coefficients 'Kf' preset in accordance with the image pattern which is determined based on the mode of operation and the average 'A'; a plurality of environment compensation coefficients 'E' predetermined in accordance with the temperature-based environment conditions; and a plurality of density compensation coefficients 'D' predetermined in accordance with the printing density of the printing data.

The toner consumption coefficient of a unit of pixel 'K', and the image pattern compensation coefficients 'Kf' are substantially identical to those stored in the toner consumption measuring apparatus 103' and the coefficient memory 122' of the embodiment of FIG. 6, and the environment compensation coefficients 'E' and the density compensation coefficients 'D' are substantially identical to those stored in the coefficient memories 122" and 122''' of the embodiments of FIGS. 8 and 10. Therefore, detailed description thereof will be omitted.

In order for the printer control unit 111"" to select one among the image pattern compensation coefficients 'Kf', one among the image compensation coefficients 'E' and one among the density compensation coefficients 'D', the toner consumption measuring apparatus 103"" is further provided with: first and second operation mode input units 121 and 142 respectively located at the printer driving program 119" of the program memory 118" of the computer 112" and the operation panel 141" of the printer 101"", for the input of operation modes; an environment condition detecting unit 151 having a temperature sensor 152 installed at a place prevented from the influence of the temperature of the laser beam printer 101", or a transfer roller resistance detecting unit 153 installed in the transfer roller 154; and first and second density input units 124 and 144 respectively located at the printer driving program 119" of the program memory 118" of the computer 112" and the operation panel 141" of the laser beam printer 101"".

The first and the second operation mode input units 121 and 142, the environment condition detecting unit 151 and the first and the second density input units 124 and 144 are substantially identical in structure and operation to those of the toner consumption measuring apparatuses 103', 103" and 103''' of the embodiments illustrated in FIGS. 6, 8, and 10, respectively, and therefore, description thereof will be omitted for the sake of brevity.

The printer control unit 111"" calculates a fifth toner consumption 'TM5' by using as compensation coefficients the image pattern compensation coefficient 'Kf' selected according to the image pattern, which is determined based on the average 'A' and the operation mode inputted through the first or the second operation mode input unit 121 or 142; the environment compensation coefficient 'E' selected according to the environment conditions updated based on the temperature detected from the environment condition detecting unit 151; and the density compensation coefficient 'D' selected according to the density information inputted through the first or the second density input unit 124 or 144. That is, the printer control unit 111"" calculates the fifth toner consumption of a page 'PTM5' by using the above coefficients 'Kf', "E' and 'D' as a compensation coefficient to compensate for the toner consumption of a page, and accumulates such calculated fifth toner consumption of a page 'PTM5' to obtain a fifth toner consumption 'TM5'.

The fifth toner consumption of a page 'PTM5' is calculated by the following equation 10:

$$PTM5=N\text{pixel}*K*Kf*D*E*E \quad (10)$$

where, 'Npixel' is the number of pixels of a page,

'K' is a toner consumption coefficient of a unit of pixel,

'Kf' is an image pattern compensation coefficient,

'D' is a density compensation coefficient, and

'E' is an environment compensation coefficient.

The fifth toner consumption 'TM5' is calculated by the following equation 11:

$$TM5=\Sigma PTM5 \quad (11)$$

Alternatively, the printer control unit 111"" may calculate a similar fifth toner consumption 'TM5'' which is similar to the above fifth toner consumption 'TM5'. The printer control unit 111"" calculates a similar fifth toner consumption of a page 'PTM5'' which is similar to the above fifth toner consumption of a page 'PTM5' by using the density compensation coefficient 'D' selected according to the density information inputted through the first or the second density input unit 124 or 144 and the environment compensation coefficient 'E' selected according to the temperature detected from the environment condition detecting unit 151, as a compensation coefficient to compensate for the first toner consumption of a page 'PTM1' which is calculated as by the printer control unit 111 of FIG. 2. The printer control unit 111"" then accumulates such calculated similar fifth toner consumption of a page 'PTM5'' and calculates a fifth toner consumption 'TM5'' which is similar to the above fifth toner consumption 'TM5'.

Alternatively, the printer control unit 111 may calculate the second or the first toner consumption of a page 'PTM2' or 'PTM1' as by the toner consumption measuring apparatus 103' or 103 of FIG. 6 or FIG. 2, respectively, accumulate such calculated second or first toner consumption of a page 'PTM2' or 'PTM1', and subsequently calculate the second or the first toner consumption 'TM2' or 'TM1'. Then, the printer control unit 111"" may select the density compensation coefficient 'D' and the environment compensation coefficient 'E', and calculate a fifth toner consumption 'TM5' or a similar toner consumption 'TM5'' by using such selected density compensation coefficient 'D' and the environment compensation coefficient 'E' as a compensation coefficient to compensate for the second or the first toner consumption 'TM2' or 'TM1'.

As described above, the toner consumption measuring apparatus 103"" according to the present embodiment uses: i) image pattern compensation coefficient 'Kf' corresponding to the image pattern which is determined in accordance with the average 'A' or both the average 'A' and the operation mode; ii) density compensation coefficient 'D' determined in accordance with the density of the printing data; and iii) environment compensation coefficient 'E' selected in accordance with the temperature detected through the environment condition detecting unit 151, to compensate for the toner consumption which is calculated based on the toner consumption coefficient 'K' of a unit of pixel and the number of pixels of a page. As a result, the present embodiment especially prevents the occurrence of errors in the measurement of the toner consumption due to varying image pattern, density and temperature. Additionally, the present embodiment can provide a more accurate toner consumption estimate than can be provided in conventional systems such as the one illustrated in FIG. 1.

The toner consumption measuring method of the printing system 100" having the toner consumption measuring apparatus 103"" constructed according to the present embodiment will be described in greater detail below with particular reference to FIGS. 12 and 13A.

First, upon a user's input through the operation panel 141", or in accordance with the command from the computer 112", operations of S1E through S8E, S8E', S8E" and S8E''' are performed in the same manner as the operations S1B through S9B of the toner consumption measuring method of the embodiment of FIG. 7. The only difference of the present embodiment is that it further includes, after the operation S3E, the operation S4E to determine the environment condition in accordance with the temperature detected through the environment detecting unit 151 and accordingly determining the environment compensation coefficient 'E', and the operation S5E to determine the density compensation coefficient 'D' in accordance with the density information inputted through the first or the second density input unit 124 or 144.

After the image pattern compensation coefficients 'Kf' is read from the coefficient memory 122"" in the operations S8E, S8E' S8E" and S8E"', the printer control unit 111"" in operation S9E uses the read image pattern compensation coefficient 'Kf', the toner consumption coefficient of a unit of pixel 'K' read from the operation S3E, the environment compensation coefficient 'E' determined in the operation S4E, the density compensation coefficient 'D' determined in the operation S5E, and the number of pixels of a page 'Npixel' counted through the counting unit 140, to calculate a fifth toner consumption of a page 'PTM5' with the equation 10 above. The image pattern compensation coefficient 'Kf', the environment compensation coefficient 'E' and the density compensation coefficient 'D' are used as the compensation coefficient to compensate for the toner consumption which is calculated based on the toner consumption coefficient of a unit of pixel 'K' and the number of pixels of a page 'Npixel'.

Next, the printer control unit 111"", in operation S10E, calculates the fifth toner consumption 'TM5' by adding up the above-calculated fifth toner consumption of a page 'PTM5' with the fifth toner consumption of a page 'PTM5' of the previous page which is stored in the data memory 130, and stores the newly calculated fifth toner consumption 'TM5' in the data memory 130.

After that, it is determined whether there is any printing or copy data for the next page in operation S11E, and if so, the operations after S2E are repeated.

If it is determined that there is no printing or copy data in the operation S1E, the printer control unit 111"" compares and analyzes the fifth toner consumption 'TM5' with a reference toner usage, and accordingly, generates a display signal. According to the display signal generated from the printer control unit 111"", the display 114 of the printer 101"" and/or the monitor 116 of the computer 112" display the fifth toner consumption 'TM5' together with the reference toner usage in operation S12E, and ends the operation.

Figure 13A:
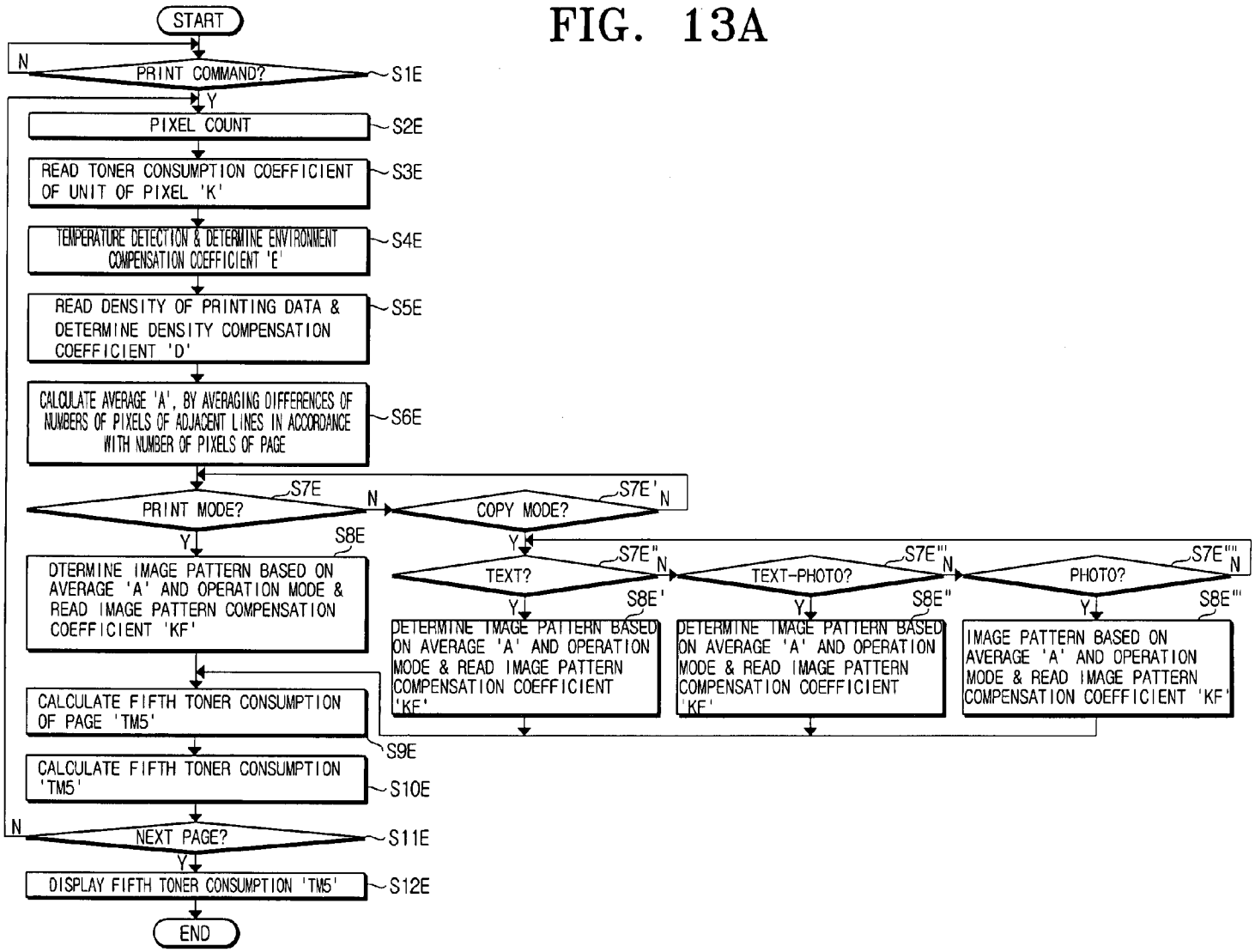
FIG. 13A is a flowchart illustrating an exemplary process of a toner consumption measuring method used with the printing system of FIG. 12.
Figure 13B:
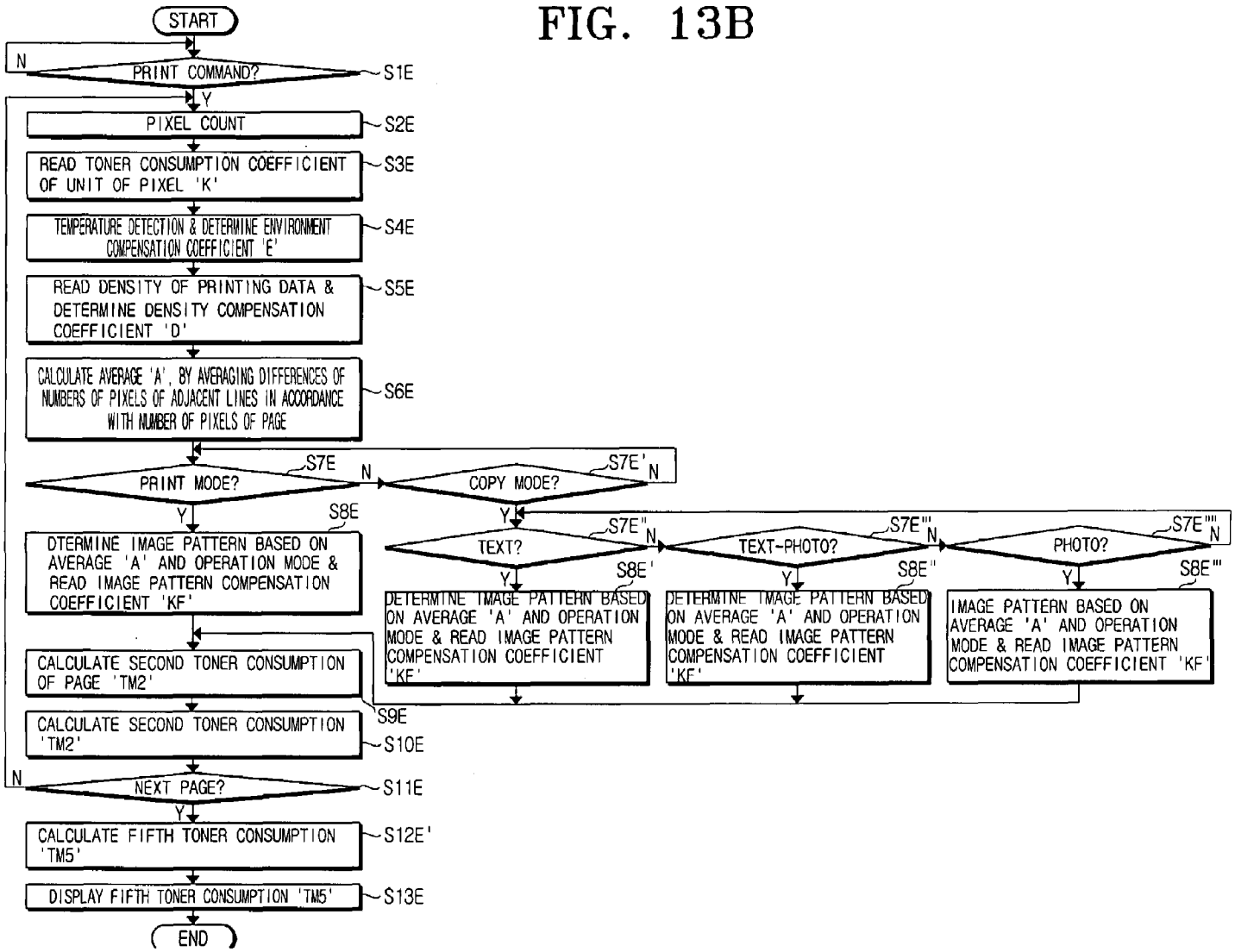
FIG. 13B shows a modified example of FIG. 13A.

FIG. 13B shows a modified example of the toner consumption measuring method of FIG. 13A according to another embodiment of the present general inventive concept.

The operations S1E through S11E of the modified example only differ from the operations S1B through S9B of FIG. 7 in view of the additional operation S4E of determining the environment conditions according to the temperature detected through the environment detecting unit 151 and accordingly determining the environment compensation coefficient 'E', and the operation S5E of determining the density compensation coefficient 'D' in accordance with the density information which is inputted through the first or the second density input unit 124 or 144.

If it is determined that there is no printing or copy data in the operation S1E, the printer control unit 111"" calculates the fifth toner consumption 'TM5' in operation S12E' by using the environment compensation coefficient 'E' determined in the operation S4E and the density compensation coefficient 'D' determined in the operation S5E as a compensation coefficient for compensating for the second toner consumption 'TM2' which is calculated from the operation S10E.

After the above operation, the printer control unit 111"" compares and analyzes the fifth toner consumption 'TM5' with a reference toner usage, and accordingly generates a display signal. In operation S13E, according to the display signal generated from the printer control unit 111"", the display 114 of the printer 101"" and/or the monitor 116 of the computer 112" display the fifth toner consumption 'TM5' together with the reference toner usage, and ends the toner consumption measurement.

Figure 14:
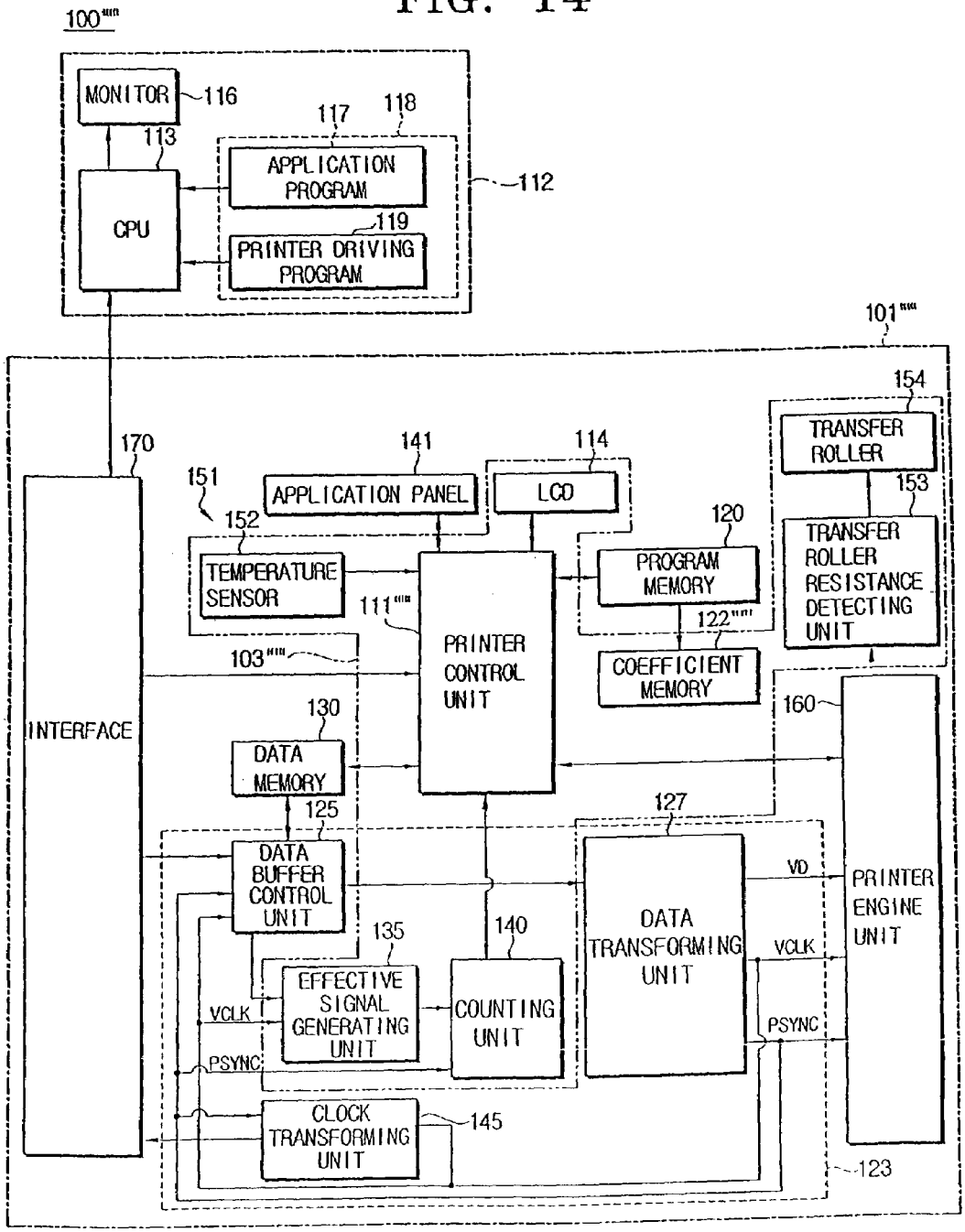
FIG. 14 is a block diagram of a printing system employing an apparatus to measure toner consumption according to yet another embodiment of the present general inventive concept.

FIG. 14 shows a printing system 100"" having a toner consumption measuring apparatus 103"" according to yet another embodiment of the present general inventive concept.

The printing system 100"" of the present embodiment is substantially the same to those of the previous embodiments (FIGS. 2, 6, 8, 10, 12), except for the toner consumption measuring apparatus 103"". Accordingly, description of the like elements will be omitted, while the toner consumption measuring apparatus 103"" will be focused on in detail hereinbelow.

The toner consumption measuring apparatus 103"" according to the present embodiment may include an effective signal generating unit 135, such as an AND gate, a counting unit 140, a coefficient memory 122"" installed in the program memory 120, an environment condition detecting unit 151, and a printer control unit 111"". The effective signal generating unit 135, such as an AND gate, receives inputs of the printing data from the buffer control unit 125 and the video clock signal 'VCLK' of the printer engine unit 160 for the synchronization of the printing data, and accordingly generates binary image data having a '0' or '1'-count effective signal. The counting unit 140 counts the counts effective signal of the binary image data and therefore calculates the number of pixels of printing data 'Pixel'. The environment condition detecting unit 151 detects the temperature which determines the environment condition, and finally, the printer control unit 111"" calculates a sixth toner consumption 'TM6' by applying suitable weight according to the environment condition which is determined in accordance with the temperature detected through the environment condition detecting unit 151.

The effective signal generating unit 135 and the counting unit 140 are substantially identical to those of FIGS. 3 and 4, and therefore, further description thereof will be omitted for the sake of brevity.

The coefficient memory 122"" stores therein a toner consumption coefficient of a unit of pixel 'K' which is set to optimum value according to experiments, and a plurality of environment compensation coefficients 'E' which are predetermined in accordance with the temperature-based environment condition.

The toner consumption coefficient of a unit of pixel 'K' and the environment compensation coefficient 'E' are substantially the same as those stored in the coefficient memory 112" of the toner consumption measuring apparatus 103" of the embodiment illustrated in FIG. 8, and therefore, a detailed description thereof will be omitted.

In order to obtain information for selection among the plurality of environment compensation coefficients 'E', the printer control unit 111"" is further provided with the environment condition detecting unit 151.

The environment condition detecting unit 151, as was described above with reference to FIG. 8, may include a temperature sensor 152 which is installed in a suitable place prevented from the influence of the temperature of the laser beam printer 101''''', or the transfer roller resistance detecting unit 153 to measure the temperature based on the resistance of the elastic layer of the transfer roller 154.

The printer control unit 111''''' selects the environment compensation coefficient 'E' based on the environment conditions such as low-temperature/low-humidity state, normal-temperature/normal-humidity state and high-temperature/high-humidity state, which are determined from the detected temperature of the environment condition detecting unit 151, and uses the selected environment compensation coefficient 'E' as a compensation coefficient to compensate for the toner consumption of a page, and therefore calculates the sixth toner consumption of a page 'TPM6' and accumulates the sixth toner consumption of a page 'TPM6' to obtain the sixth toner consumption 'TM6'.

The toner consumption of a page 'TPM6' is calculated by the following equation 12:

$$TPM6=N\text{pixel}*K*E \tag{12}$$

where, 'Npixel' is a number of pixels of a page,

'K' is a toner consumption coefficient of a unit of pixel, and

'E' is an environment compensation coefficient

The sixth toner consumption 'TM6' is calculated by the following equation 13:

$$TM6=\Sigma PTM6 \tag{13}$$

As described above, the toner consumption measuring apparatus 103''''' according to the embodiment of FIG. 14 selects the environment compensation coefficient 'E' according to the temperature-based environment conditions, and uses the selected environment compensation coefficient 'E' as a compensation coefficient to compensate for the toner consumption, which is calculated based on the toner consumption coefficient 'K' of a unit of pixel and the number of pixels of a page. Accordingly, errors in measuring toner consumption can be prevented, and toner consumption can be estimated more accurately.

Figure 15:
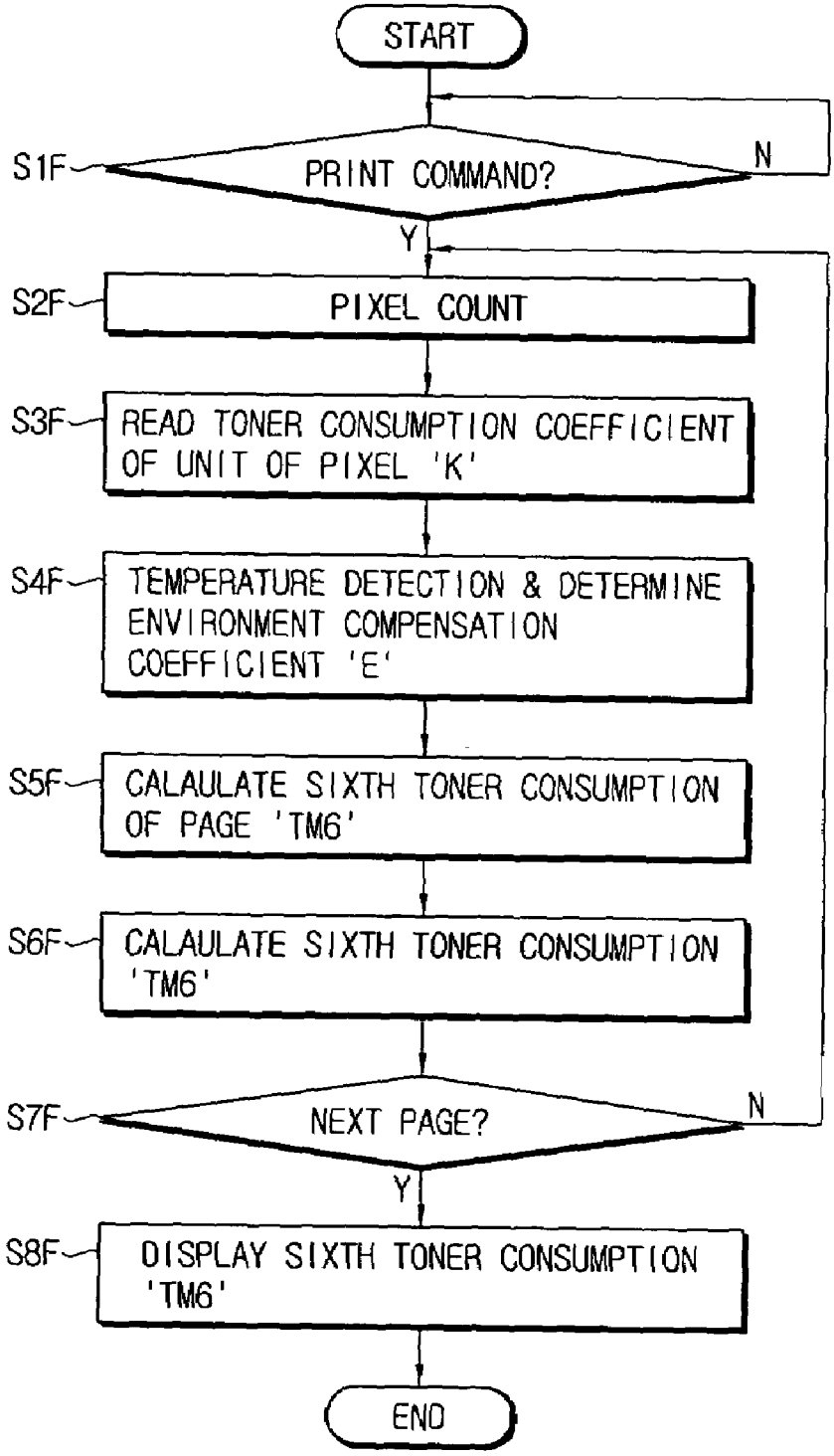
FIG. 15 is a flowchart illustrating an exemplary process of a toner consumption measuring method used with the printing system of FIG. 14.

A toner consumption measuring method of the printing system 100''''' having the toner consumption measuring apparatus 103''''' according to FIG. 14 will be described in detail with reference to FIGS. 14 and 15.

First, upon a user's input through the operation panel 141, or in accordance with the command from the computer 112, the operations S1F through S4F are performed in the same way as the operations S1C through S4C of the embodiment illustrated in FIG. 9A.

When the environment compensation coefficient 'E' is determined in the operation S4F, the printer control unit 111''''', in operation S5F, uses the determined environment compensation coefficient 'E', the toner consumption coefficient of a unit of pixel 'K' read from the operation S3F and the number of pixels of a page 'Npixel' counted from the counting unit 140, to calculate the sixth toner consumption of a page 'TPM6' in accordance with the equation 12 above. The environment compensation coefficient 'E' is used as a compensation coefficient to compensate for the toner consumption which is calculated by using the toner consumption coefficient of a unit of pixel 'K' and the number of pixels of a page 'Npixel'.

After that, in operation S6F, the printer control unit 111''''' adds up the sixth toner consumption of a page 'TPM6' with the sixth toner consumption of a page 'TPM6' of the previous page stored in the data memory 130, to calculate the sixth toner consumption 'TM6', and stores the calculated sixth toner consumption 'TM6' in the data memory 130.

It is then determined whether there is any printing or copy data left for the next page in operation S7F, and if so, the operations after the operation S2F are repeated.

If it is determined that there is no printing or copy data in operation S7F, the printer control unit 111''''' compares and analyzes the sixth toner consumption 'TM6' with a reference toner usage, and accordingly generates a display signal. In operation S8F, according to the display signal generated from the printer control unit 111''''', the display 114 of the printer 101''''' and/or the monitor 116 of the computer 112 display the sixth toner consumption 'TM6' together with the reference toner usage, and the toner consumption measuring operation is completed.

Figure 16:
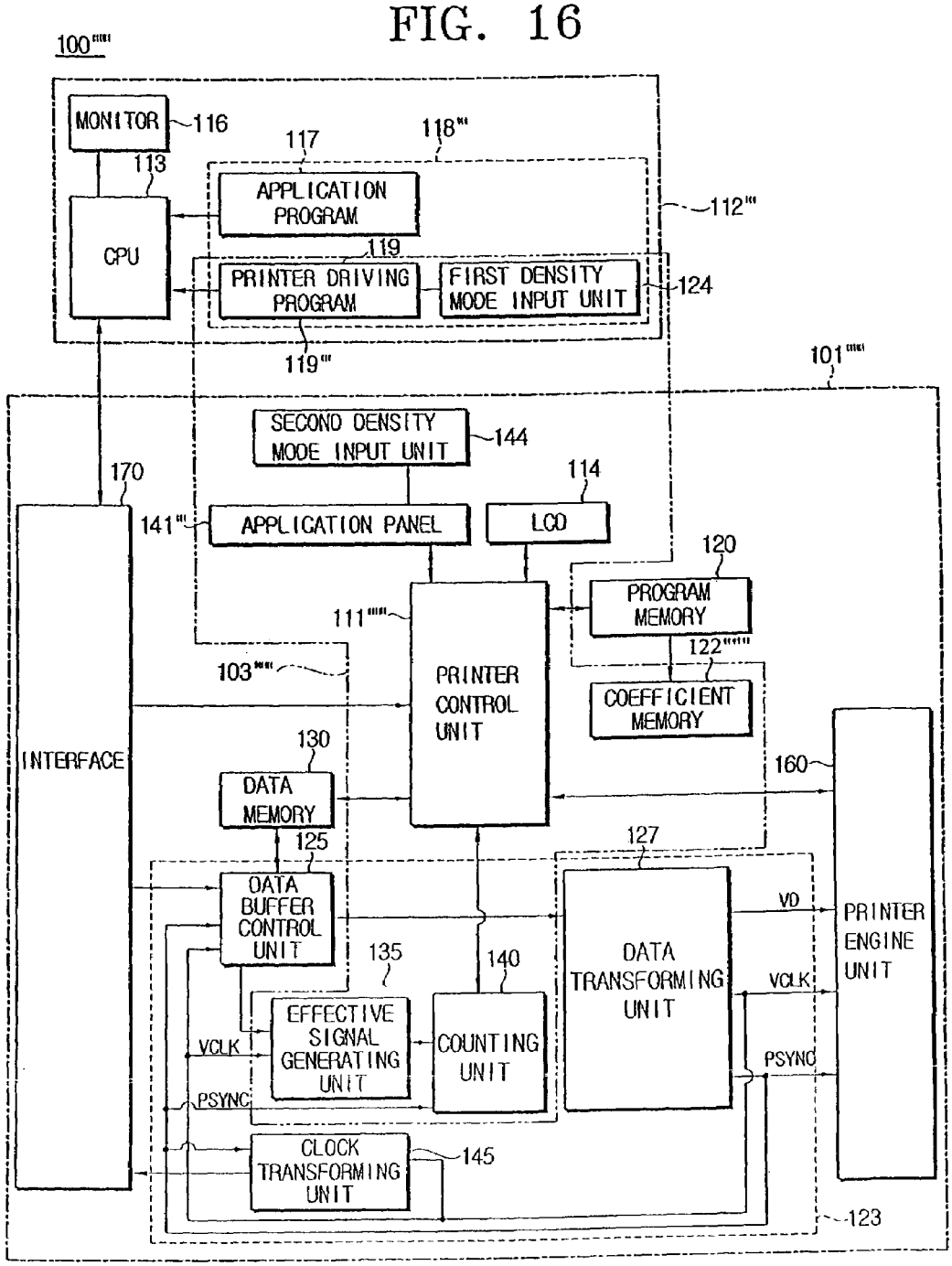
FIG. 16 is a block diagram of a printing system employing an apparatus to measure toner consumption according to yet another embodiment of the present general inventive concept.

FIG. 16 shows a printing system 100''''' having a toner consumption measuring apparatus 103''''' according to another embodiment of the present general inventive concept.

The printing system 100''''' according to the embodiment of FIG. 16 is substantially similar to the printing systems of 100, 100', 100'', 100''', 100'''' and 100''''' of FIGS. 2, 6, 8, 10, 12, 14, respectively, in structure and operation, except for the toner consumption measuring apparatus 103''''' thereof. Accordingly, the like elements will not be described below, and only the toner consumption measuring apparatus 103''''' will be mainly discussed.

The toner consumption measuring apparatus 103''''' according to FIG. 16 comprises an effective signal generating unit 135, such as an AND gate, a counting unit 140, a coefficient memory 122''''' installed in the program memory 120, and a printer control unit 111'''''. The effective signal generating unit 135 such as an AND gate receives inputs of printing data from the data buffer control unit 125 and the video clock signal 'VCLK' of the printer engine unit 160 for the synchronization of the printing data, and generates binary image data having '0' or '1'-count effective signals. The counting unit counts the count effective signals of the binary image data and accordingly calculates the number of pixels per printing data 'Pixel'. The printer control unit 111''''' calculates a seventh toner consumption 'TM7' by applying suitable weight in accordance with the density information of the printing data.

The effective signal generating unit 135 and the counting unit 140 are substantially the same as those of FIGS. 3 and 4, and therefore, they will not be described.

The coefficient memory 122''''' stores therein the toner consumption coefficient of a unit of pixel 'K' which is set to optimum value according to experiments, and a plurality of density compensation coefficients 'D' predetermined in accordance with the density information of the printing data.

The toner consumption coefficient of a unit of pixel 'K' and the density compensation coefficient 'D' are substantially to the same as those stored in the coefficient memory 122''' of the toner consumption measuring apparatus 103''' according the embodiment of FIG. 10, and therefore, these also will not be described.

Density information is inputted so that the printer control unit 111''''' can select one among the plurality of density compensation coefficients 'D' stored in the coefficient memory 122'''''. Accordingly, the toner consumption measuring apparatus 103''''' further includes for the input of density information, the first and second density input units 124 and 144 which are respectively located at the printer driving program 119''' of the program memory 118''' of the computer 112''' and the operation panel 141''' of the laser beam printer 101'''''.

The printer control unit 111''''' selects the density compensation coefficient 'D' based on the density information such as light-printing, normal-printing and dark-printing, which are inputted through the first or the second density input unit 124 or 144, and uses the selected density compensation coefficient 'D' as a compensation coefficient to compensate for the toner consumption of a page, and therefore calculates the seventh toner consumption of a page 'TPM7' and accumulates the seventh toner consumption of a page 'TPM7' to obtain the seventh toner consumption 'TM7'.

The seventh toner consumption of a page 'TPM7' is calculated by the following equation 14:

$$TPM7=N\text{pixel}*K*E \quad (14)$$

where, 'Npixel' is a number of pixels of a page,

'K' is a toner consumption coefficient of a unit of pixel, and

'E' is a density compensation coefficient.

The seventh toner consumption 'TM7' is calculated by the following equation 15:

$$TM7=\Sigma PTM7 \quad (15)$$

As described above, the toner consumption measuring apparatus 103"""" according to the present embodiment selects the density compensation coefficient 'D' according to the printing density of the printing data, and uses the selected density compensation coefficient 'D' as a compensation coefficient to compensate for the toner consumption, which is calculated based on the toner consumption coefficient 'K' of a unit of pixel and the number of pixels of a page. Accordingly, errors in measuring toner consumption can be prevented, and toner consumption can be estimated more accurately.

Figure 17:
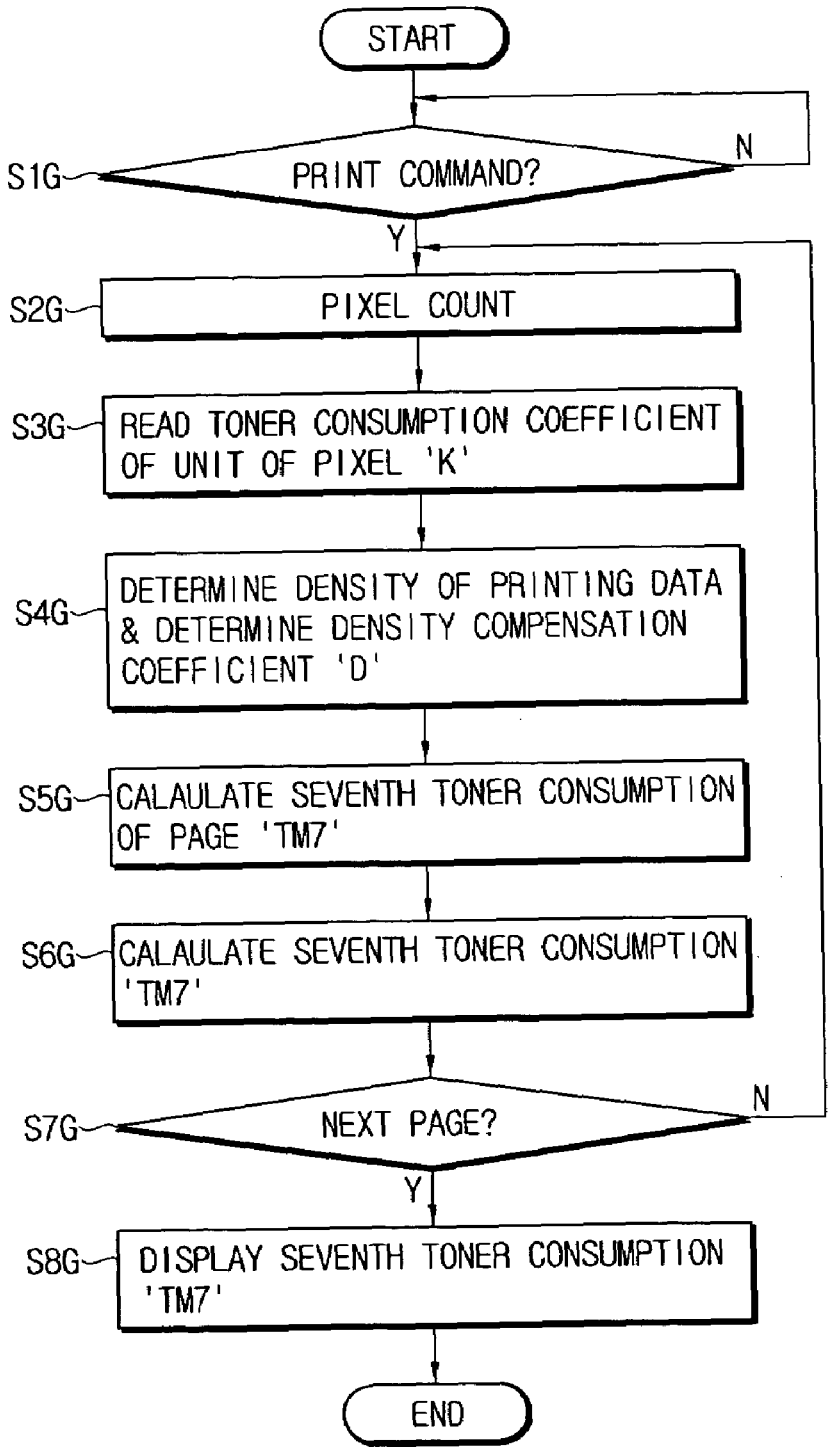
FIG. 17 is a flowchart illustrating an exemplary process of measuring toner consumption in the printing system of FIG. 16.

The toner consumption measuring method of the printing system 100"""" having the toner consumption measuring apparatus 103"""" will be described in detail with reference to FIGS. 16 and 17.

First, upon user's input through the operation panel 141''', or in accordance with the command from the computer 112''', the operations S1G through S4G are performed in the same way as the operations S1D through S4D of FIG. 11A.

When the density compensation coefficient 'D' is determined in the operation S4G, the printer control unit 111"""", in operation S5G, uses the determined density compensation coefficient 'D', the toner consumption coefficient of a unit of pixel 'K' read from the operation S3G and the number of pixels of a page 'Npixel' counted from the counting unit 140, to calculate the seventh toner consumption of a page 'TPM7' in accordance with the equation 14. The density compensation coefficient 'D' is used as a compensation coefficient to compensate for the toner consumption which is calculated by using the toner consumption coefficient of a unit of pixel 'K' and the number of pixels of a page 'Npixel'.

After that, in operation S6G, the printer control unit 111"""" adds up the seventh toner consumption of a page 'TPM7' with the seventh toner consumption of a page 'TPM7' of the previous page stored in the data memory 130, to calculate the seventh toner consumption 'TM7', and stores the calculated seventh toner consumption 'TM7' in the data memory 130.

It is then determined whether there is any printing or copy data left for the next page in operation S7G, and if so, the operations following the operation S2G are repeated.

If it is determined that there is no printing or copy data in operation S7G, the printer control unit 111"""" compares and analyzes the seventh toner consumption 'TM7' with a reference toner usage, and accordingly generates a display signal. In operation S8G, according to the display signal generated from the printer control unit 111"""", the display 114 of the printer 101"""" and/or the monitor 116 of the computer 112''' display the seventh toner consumption 'TM7' together with the reference toner usage, and the toner consumption measuring operation is completed.

As described above in various exemplary embodiments of the present general inventive concept, a toner consumption is measured based on the average 'A', which is obtained by averaging the differences of numbers of pixels of adjacent lines according to the number of pixels of a page 'Npixel', and also based on the modes of operation and image patterns. As a result, error in the measurement of toner consumption is prevented, and more accurate measurement can be provided.

Additionally, because the toner consumption can be measured by applying different weights in accordance with varying environments such as temperature and humidity, more accurate measurement of toner consumption can be provided.

Furthermore, the toner consumption is measured by applying different weights in accordance with the printing density as inputted. Therefore, error in toner consumption measurement due to varying printing density can be prevented, and accurate toner measurement can be provided.

Although various exemplary embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A toner consumption measuring apparatus of a printing system having an image forming apparatus therein, comprising:

an effective signal generating unit to receive inputs of printing data and a video clock signal 'VCLK' to synchronize the printing data, and to generate a count effective signal;

a counting unit to count the generated count effective signal and to calculate a number of pixels of the printing data;

a coefficient memory to store at least a toner consumption coefficient of a unit of pixel 'K' which is set in advance; and a printer control unit to determine an image pattern compensation coefficient by using the differences of numbers of the pixels of adjacent lines of a page in printing of every page, and calculating a toner consumption with applying a proper weight in accordance with the determined image pattern compensation coefficient.

2. The toner consumption measuring apparatus of claim 1, wherein the image pattern compensation coefficient is determined based on an average 'A', which is obtained by averaging the differences of numbers of pixels of adjacent lines in accordance with the number of pixels of a page 'Npixel', and based on the following equation:

$$A = \frac{1}{M}\sum\frac{(NLpixel - N1Lpixel)}{Npixel}$$

where, 'NLpixel' is a number of pixels of Nth line of a page,

'N1Lpixel' is a number of pixels of (N+1)th line of a page,

'Npixel' is a number of pixels of a page, and

'M' is a number of adjacent lines of a page (that is, total lines of a page-1).

3. The toner consumption measuring apparatus of claim 2, wherein the printer control unit uses the average 'A' as a compensation coefficient to compensate for the toner consumption, which is calculated by using the number of pixels of a page 'Npixel' and the toner consumption coefficient of a unit of pixel 'K', to calculate a first toner consumption of a page 'PTM1' and accumulate the first toner consumption of a page 'PTM1' to calculate a first toner consumption 'TM1'.

4. The toner consumption measuring apparatus of claim 3, wherein the coefficient memory further stores therein at least one among:

a plurality of environment compensation coefficients 'E' which are predetermined in accordance with the environment conditions based on at least one among temperature and humidity; and a plurality of density compensation coefficients 'D' which are predetermined based on the printing density of the printing data.

5. The toner consumption measuring apparatus of claim 4, further comprising at least one among:

an environment condition detecting unit to detect temperature inside the image forming apparatus and to output the result to the printer control unit; and a density input unit located in at least one of a printer driving program of an external computer and an operation panel of the image forming apparatus, the environment condition detecting unit further comprising at least one among:

a temperature sensor located at a proper place in the image forming apparatus while being prevented from the temperature of the image forming apparatus, to determine whether or not it is the temperature for normal operation of the image forming apparatus; and a transfer roller resistance detecting unit arranged relative to the transfer roller to determines whether or not a current atmospheric temperature is for normal operation of the transfer roller.

6. The toner consumption measuring apparatus of claim 1, wherein the image pattern compensation coefficient is determined as a plurality of image pattern compensation coefficients 'Kf' predetermined in accordance with an image pattern of the printing data and stored in the coefficient memory, the image pattern of the printing data being determined based on an average 'A', which is obtained by averaging the differences of numbers of pixels of adjacent lines in accordance with the number of pixels of a page 'Npixel', and based on the following equation:

$$A = \frac{1}{M}\sum\frac{(NLpixel - N1Lpixel)}{Npixel}$$

where, 'NLpixel' is a number of pixels of Nth line of a page,

'N1Lpixel' is a number of pixels of (N+1)th line of a page,

'Npixel' is a number of pixels of a page, and

'M' is a number of adjacent lines of a page (that is, total lines of page-1).

7. The toner consumption measuring apparatus of claim 6, wherein the printer control unit selects one among the plurality of image pattern compensation coefficients 'Kf' based on the image pattern which is determined based on the operation mode and the average 'A', calculates a second toner consumption of a page 'PTM2' by using the selected image pattern compensation coefficient 'Kf' as a compensation coefficient to compensate for a toner consumption which is calculated by using the number of pixels of a page 'Npixel' and the toner consumption coefficient of a unit of pixel 'K', and then calculates a second toner consumption 'TM2' by accumulating the second toner consumption of a page 'PTM2'.

8. The toner consumption measuring apparatus of claim 7, wherein the toner consumption measuring apparatus further comprises:

an operation mode input unit located in at least one of a printer driving program of an external computer and an operation panel of the image forming apparatus to input information for the printer control unit's selection of one image pattern compensation coefficient 'Kf'.

9. The toner consumption measuring apparatus of claim 8, wherein the operation mode input unit comprises:

a print mode button to select a print mode; and a copy mode button to select a copy mode.

10. The toner consumption measuring apparatus of claim 9, wherein the copy mode button comprises sub-taps such as text tap, text-photo tap, and photo tap.

11. The toner consumption measuring apparatus of claim 7, wherein the coefficient memory further stores therein at least one among:

a plurality of environment compensation coefficients 'E' which are predetermined in accordance with the environment conditions based on at least one among temperature and humidity; and a plurality of density compensation coefficients 'D' which are predetermined based on printing density of the printing data.

12. The toner consumption measuring apparatus of claim 11, further comprising at least one among:

an environment condition detecting unit to detect temperature inside the image forming apparatus and outputting the result to the printer control unit; and a density input unit located in at least one of a printer driving program of an external computer and an operation panel of the image forming apparatus, the environment condition detecting unit further comprising at least one among:

a temperature sensor located at a proper place in the image forming apparatus while being prevented from the temperature of the image forming apparatus, to determine whether or not it is the temperature for normal operation of the image forming apparatus; and a transfer roller resistance detecting unit arranged in relative to the transfer roller to determines whether or not a current atmospheric temperature is for normal operation of the transfer roller.

13. A toner consumption measuring apparatus of a printing system having an image forming apparatus therein, comprising:

an effective signal generating unit to receive inputs of printing data and a video clock signal 'VCLK' to synchronize the printing data, and to generate a count effective signal;

a counting unit to count the generated count effective signal and to calculate a number of pixels of the printing data;

a coefficient memory to store therein a toner consumption coefficient of a unit of pixel 'K' which is set in advance, and a plurality of environment compensation coefficients 'E' which are predetermined in accordance with predetermined environment conditions based on at least one among the temperature and humidity; and a printer control unit to calculate a sixth toner consumption 'TM6' by selecting one among the plurality of environment compensation coefficients 'E' in accordance with at least one among the temperature and the humidity, and using the selected environment compensation coefficient 'E' as a compensation coefficient to compensate for a toner consumption, which is calculated by using the toner consumption coefficient of a unit of pixel 'K' stored in the coefficient memory and the counted number of pixels of the printing data.

14. The toner consumption measuring apparatus of claim 13, further comprising an environment condition detecting unit to detect at least one of the temperature and humidity of the image forming apparatus and output the result to the printer control unit.

15. The toner consumption measuring apparatus of claim 14, wherein the environment condition detecting unit comprises either a temperature sensor located within the image forming apparatus to determine whether the current atmospheric temperature is for normal operation of the image forming apparatus, or a transfer roller resistance detecting unit positioned relative to a transfer roller to determine whether the current atmospheric temperature is for normal operation of the transfer roller.

16. A toner consumption measuring apparatus of a printing system having an image forming apparatus therein, comprising:

an effective signal generating unit to receive inputs of printing data and a video clock signal 'VCLK' to synchronize the printing data, and to generate a count effective signal;

a counting unit to count the generated count effective signal and to calculate a number of pixels of the printing data;

a coefficient memory to store therein a toner consumption coefficient of a unit of pixel 'K' which is set in advance, and a plurality of density compensation coefficients 'D' which are predetermined in accordance with printing density of the printing data; and a printer control unit to calculate a seventh toner consumption 'TM7' by selecting one among the plurality of density compensation coefficients 'D' in accordance with the printing density of the printing data, and using the selected density compensation coefficient 'D' as a compensation coefficient to compensate for a toner consumption, which is calculated by using the toner consumption coefficient of a unit of pixel 'K' stored in the coefficient memory and the counted number of pixels of the printing data.

17. The toner consumption measuring apparatus of claim 16, further comprising a density input unit in at least one among a printer driver program of an external computer and an operation panel of the image forming apparatus to input information for the printer control unit to select one among the plurality of stored density compensation coefficients 'D' for the coefficient memory.

18. The toner consumption measuring apparatus of claim 17, wherein the density input unit comprises a light-printing button, a normal-printing button, and a dark-printing button.

19. A toner consumption measuring method of an image forming apparatus, comprising:

counting the number of pixels of printing data;

determining an image pattern compensation coefficient by using differences of the numbers of pixels of adjacent lines of a page in the printing of every page; and calculating a toner consumption with applying a proper weight in accordance with the determined image pattern compensation coefficient.

20. The toner consumption measuring method of claim 19, wherein the operation of determining the image pattern compensation coefficient comprises:

calculating an average 'A' by averaging the differences of numbers of pixels of adjacent lines of a page in accordance with the number of pixels of a page 'Npixel' in the printing of every page, and in accordance with the following equation:

$$A = \frac{1}{M}\sum\frac{(NLpixel - N1Lpixel)}{Npixel}$$

where, 'NLpixel' is a number of pixels of Nth line of a page,

'N1Lpixel' is a number of pixels of (N+1)th line of a page,

'Npixel' is a number of pixels of a page, and

'M' is a number of adjacent lines of a page (that is, total lines of a page-1).

21. The toner consumption measuring method of claim 20, wherein the operation of calculating a toner consumption comprising:

calculating a first toner consumption of a page 'PTM1' by using the calculated average 'A' as a compensation coefficient to compensate for the toner consumption which is calculated by using the number of pixels of a page 'Npixel' and the toner consumption coefficient of a unit of pixel 'K'; and calculating a first toner consumption 'TM1' by accumulating the first toner consumption of a page 'PTM1'.

22. The toner consumption measuring method of claim 21, further comprising:

selecting one among a plurality of environment compensation coefficients 'E' which are predetermined based on at least one among environment conditions including temperature and humidity; and calculating one among a third toner consumption of a page 'PTM3' and a similar third toner consumption of a page 'PTM3'' by using the selected environment compensation coefficient 'E' as a compensation coefficient to compensate for one among a second toner consumption of a page 'PTM2' and the first toner consumption of a page 'PTM1', and calculating one among a third toner consumption 'TM3' and a similar third toner consumption 'TM3'' by accumulating the third toner consumption of a page 'PTM3' or the similar third toner consumption of a page 'PTM3''.

23. The toner consumption measuring method of claim 21, comprising:

selecting one among a plurality of environment compensation coefficients 'E' which are predetermined based on at least one environment conditions including temperature and humidity; and calculating one among the third toner consumption 'TM3' and the similar third toner consumption 'TM3'' by using the selected environment compensation coefficient 'E' as a compensation coefficient for compensating for one among the second toner consumption 'TM2' and the first toner consumption 'TM1'.

24. The toner consumption measuring method of claim 21, further comprising:

selecting one among a plurality of density compensation coefficients 'D' which are predetermined based on the printing density of the printing data; and calculating one among a fourth toner consumption 'TM4' and a similar fourth toner consumption 'TM4'' by using the selected density compensation coefficient 'D' as a compensation coefficient to compensate for one among the second toner consumption 'TM2' and the first toner consumption 'TM1', and the calculating one among a fourth toner consumption 'TM4' and a similar fourth toner consumption 'TM4'' by accumulating the calculated fourth toner consumption of a page 'PTM4' or the calculated similar fourth toner consumption of a page 'PTM4''.

25. The toner consumption measuring method of claim 21, further comprising:

selecting one among a plurality of density compensation coefficients 'D' which are predetermined based on the printing density of the printing data; and calculating one among a fourth toner consumption 'TM4' and a similar fourth toner consumption 'TM4'' by using the selected density compensation coefficient 'D' as a compensation coefficient to compensate for one among the second toner consumption 'TM2' and the first toner consumption 'TM1'.

26. The toner consumption measuring method of claim 19, wherein the operation of determining the image pattern compensation coefficient comprises:

selecting one among a plurality of predetermined image pattern compensation coefficients 'Kf' in accordance with the mode of operation and an average 'A', which is obtained by averaging the differences of numbers of pixels of adjacent lines in accordance with the number of pixels of a page 'Npixel' and based on the following equation:

$$A = \frac{1}{M}\sum\frac{(NLpixel - N1Lpixel)}{Npixel}$$

where, 'NLpixel' is a number of pixels of Nth line of a page,

'N1Lpixel' is a number of pixels of (N+1)th line of a page,

'Npixel' is a number of pixels of a page, and

'M' is a number of adjacent lines of a page (that is, total lines of page-1).

27. The toner consumption measuring method of claim 26, wherein the operation of calculating the toner consumption comprises:

calculating a second toner consumption of a page 'PTM2' by using the selected image pattern compensation coefficient 'Kf' as a compensation coefficient to compensate for a toner consumption which is calculated by using the number of pixels of a page 'Npixel' and the toner consumption coefficient of a unit of pixel 'K'; and calculating a second toner consumption 'TM2' by accumulating the second toner consumption of a page 'PTM2'.

28. The toner consumption measuring method of claim 27, further comprising:

selecting one among a plurality of environment compensation coefficients 'E' which are predetermined based on at least one among the environment conditions including temperature and humidity; and calculating one among a third toner consumption of a page 'PTM3' and a similar third toner consumption of a page 'PTM3'', by using the selected environment compensation coefficient 'E' as a compensation coefficient for compensating for one among the second toner consumption of a page 'PTM2' and the first toner consumption of a page 'PTM1', and calculating one among a third toner consumption 'TM3' and a similar third toner consumption 'TM3'' by accumulating the third toner consumption of a page 'PTM3' or the similar third toner consumption of a page 'PTM3''.

29. The toner consumption measuring method of claim 27, further comprising:

selecting one among a plurality of environment compensation coefficients 'E' which are predetermined based on at least one environment conditions including temperature and humidity; and calculating one among the third toner consumption 'TM3' and the similar third toner consumption 'TM3'' by using the selected environment compensation coefficient 'E' as a compensation coefficient to compensate for one among the second toner consumption 'TM2' and a first toner consumption 'TM1'.

30. The toner consumption measuring method of claim 27, comprising:

selecting one among a plurality of density compensation coefficients 'D' which are predetermined based on the printing density of the printing data; and calculating one among a fourth toner consumption 'TM4' and a similar fourth toner consumption 'TM4'' by using the selected density compensation coefficient 'D' as a compensation coefficient to compensate for one among the second toner consumption 'TM2' and the first toner consumption 'TM1', and the calculating one among a fourth toner consumption 'TM4' and a similar fourth toner consumption 'TM4'' by accumulating the calculated fourth toner consumption of a page 'PTM4' or the calculated similar fourth toner consumption of a page 'PTM4''.

31. The toner consumption measuring method of claim 27, further comprising:

selecting one among a plurality of density compensation coefficients 'D' which are predetermined based on the printing density of the printing data; and calculating one among a fourth toner consumption 'TM4' and a similar fourth toner consumption 'TM4'' by using the selected density compensation coefficient 'D' as a compensation coefficient to compensate for one among the second toner consumption 'TM2' and the a first toner consumption 'TM1'.

32. A toner consumption measuring method of an image forming apparatus, comprising:

determining an environment compensation coefficient 'E' based on at least one information including temperature and humidity; and calculating a sixth toner consumption 'TM6' by using the determined environment compensation coefficient 'E' as a compensation coefficient to compensate for a toner consumption, which is calculated by using a toner consumption coefficient of a unit of pixel 'K' which is set in advance, and a number of pixels of the printing data.

33. A toner consumption measuring method of an image forming apparatus, comprising:

counting a number of pixels of printing data;

determining a density compensation coefficient 'D' in accordance with the density information of the printing data; and calculating a seventh toner consumption 'TM7' by using the determined density compensation coefficient 'D' as a compensation coefficient to compensate for a toner consumption, which is calculated by using a toner consumption coefficient of a unit of pixel 'K' which is set in advance, and the counted number of pixels of the printing data.

* * * * *